US005218407A

United States Patent [19]

Matsushita et al.

[11] Patent Number: 5,218,407

[45] Date of Patent: Jun. 8, 1993

[54] APPARATUS FOR INITIAL SET-UP OF DEVELOPER UNIT IN AN IMAGE FORMING APPARATUS

[75] Inventors: Tetsuo Matsushita, Shinshiro; Shoji Kashiwagi, Okazaki; Tsuneo Kitagawa, Toyohashi; Hiromitsu Saijo, Toyokawa, all of Japan

[73] Assignee: Minolta Camera Kabushiki Kaisha, Osaka, Japan

[21] Appl. No.: 871,565

[22] Filed: Apr. 17, 1992

Related U.S. Application Data

[63] Continuation of Ser. No. 602,854, Oct. 24, 1990, abandoned.

[30] Foreign Application Priority Data

| | | | |
|---|---|---|---|
| Oct. 24, 1989 | [JP] | Japan | 1-277569 |
| Oct. 24, 1989 | [JP] | Japan | 1-277570 |
| Oct. 24, 1989 | [JP] | Japan | 1-277571 |
| Oct. 24, 1989 | [JP] | Japan | 1-277572 |

[51] Int. Cl.[5] ..... G03G 15/08

[52] U.S. Cl. ..... 355/208; 355/246; 355/260; 355/245

[58] Field of Search ..... 355/205-208, 355/245, 246, 260, 203

[56] References Cited

U.S. PATENT DOCUMENTS

| | | | |
|---|---|---|---|
| 4,611,730 | 9/1986 | Ikesue et al. | 222/167 |
| 4,625,895 | 12/1986 | Tsukano | 355/260 X |
| 4,629,309 | 12/1986 | Tsukano et al. | 355/245 |
| 4,744,493 | 5/1988 | Ikesue | 222/167 |
| 4,956,668 | 9/1990 | Arnold et al. | 355/208 |
| 4,974,020 | 11/1990 | Takamatsu et al. | 355/245 X |

FOREIGN PATENT DOCUMENTS

| | | | |
|---|---|---|---|
| 58-195854 | 11/1983 | Japan . | |
| 61-39061 | 2/1986 | Japan | 355/245 |

*Primary Examiner*—Joan H. Pendegrass
*Attorney, Agent, or Firm*—Willian Brinks Olds Hofer Gilson & Lione

[57] ABSTRACT

An image forming apparatus is provided with a developing unit for making a visible image out of an electrostatic latent image with use of developer. The apparatus has a determination unit for making a determination as to whether the developer is stored or not in the developing unit, a supply unit for supplying the developer from a bottle detachably provided to body of the apparatus to the developing unit, and a control unit for actuating supply operation by the supply unit when it is determined by the determination unit that no developer is stored in the developing unit.

14 Claims, 38 Drawing Sheets

COPY START CHECK

#951
COPY START ?
NO
YES
#952
STATE ← 1H
#955
WARMING-UP ?
YES
NO
#956
DEVELOPER SET REQUESTED ?
YES
#958
STATE ← 30H
NO
#957
CLEAR CARRY FLAG
NO
#953
SET OPERATION FLAG
#954
SET CARRY FLAG
YES

APPARATUS FOR INITIAL SET-UP OF DEVELOPER UNIT IN AN IMAGE FORMING APPARATUS

This application is a continuation of application Ser. No. 07/602,854, filed Oct. 24, 1990, now abandoned.

BACKGROUND OF THE INVENTION

1. Field of the Invention

The present invention generally relates to image forming apparatuses such as copying machine and laser printer, and more particularly, to an image forming apparatus in which developer loading work conducted for a developing unit especially in setting up the apparatus is simplified.

2. Description of the Related Art

In order to set up a copying machine and make initial adjustments of the copying machine at a service place, service men have used to visit the place to install the machine for users. Among the setting-up works, there is a loading work of developer, called "starter", to a developing unit. This work is to load a developing unit uniformly with developer (when it is of two component system, a mixed developer of toner and carrier) in a container and has been done by a service man who draws the developing unit out of body of the machine to load the same.

However, if such service men have to be sent to every installation place to set up a machine and make some adjustments, various costs involved in such works add to cost of the copying machine itself. This has been a great factor of an increased cost especially in the cases of low-price small-size machines.

SUMMARY OF THE INVENTION

An object of the present invention is to reduce cost of an image forming apparatus.

Another object of the present invention is to simplify the developer loading work in an image forming apparatus.

Still another object of the present invention is to simplify the setting-up work of an image forming apparatus.

Still another object of the present invention is to obviate troubles which might occur in setting up an image forming apparatus.

In order to achieve the objects above, an image forming apparatus according to an aspect of the present invention is provided with a developing unit which makes a visible image out of an electrostatic latent image using developer, and comprises determination means for making a determination as to whether the developer is stored in the developing unit or not, supply means for supplying the developer from a bottle detachably provided on the body of the apparatus to the developing unit, and control means for actuating, in response to a determination output from the determination means indicating that no developer is stored in the developing unit, supply operation by the supply means.

The image forming apparatus configured in the manner described above can be easily set up since at least either of toner and carrier is supplied by the supply means when no carrier is stored in the developing unit.

In order to achieve the objects above, an image forming apparatus according to another aspect of the present invention is provided with a developing unit which makes a toner image out of an electrostatic latent image using developer composed of toner and carrier, and comprises supply means for supplying at least either of toner and carrier from a bottle detachably provided to body of the apparatus on the developing unit, detection means for detecting that the toner concentration in the developing unit is below a predetermined value, first control means for actuating the supply means in response to a detection output of the detection means, determination means for determining whether the developing unit has been used or not, and second control means for actuating the supply means in response to a determination output from the determination means indicating that the developing unit has not been used yet.

The image forming apparatus configured as described above can be easily set up since at least either of toner and carrier is supplied when the developing unit has not been used yet, as well as when the toner concentration in the developing unit is low.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 15 is a flow chart diagram showing specific contents of the copy start check routine employed in FIG. 14A and the like.

DESCRIPTION OF THE PREFERRED EMBODIMENTS

In the following, the present invention will be described in detail with reference to the accompanying drawings showing an embodiment thereof.

Figure 1:
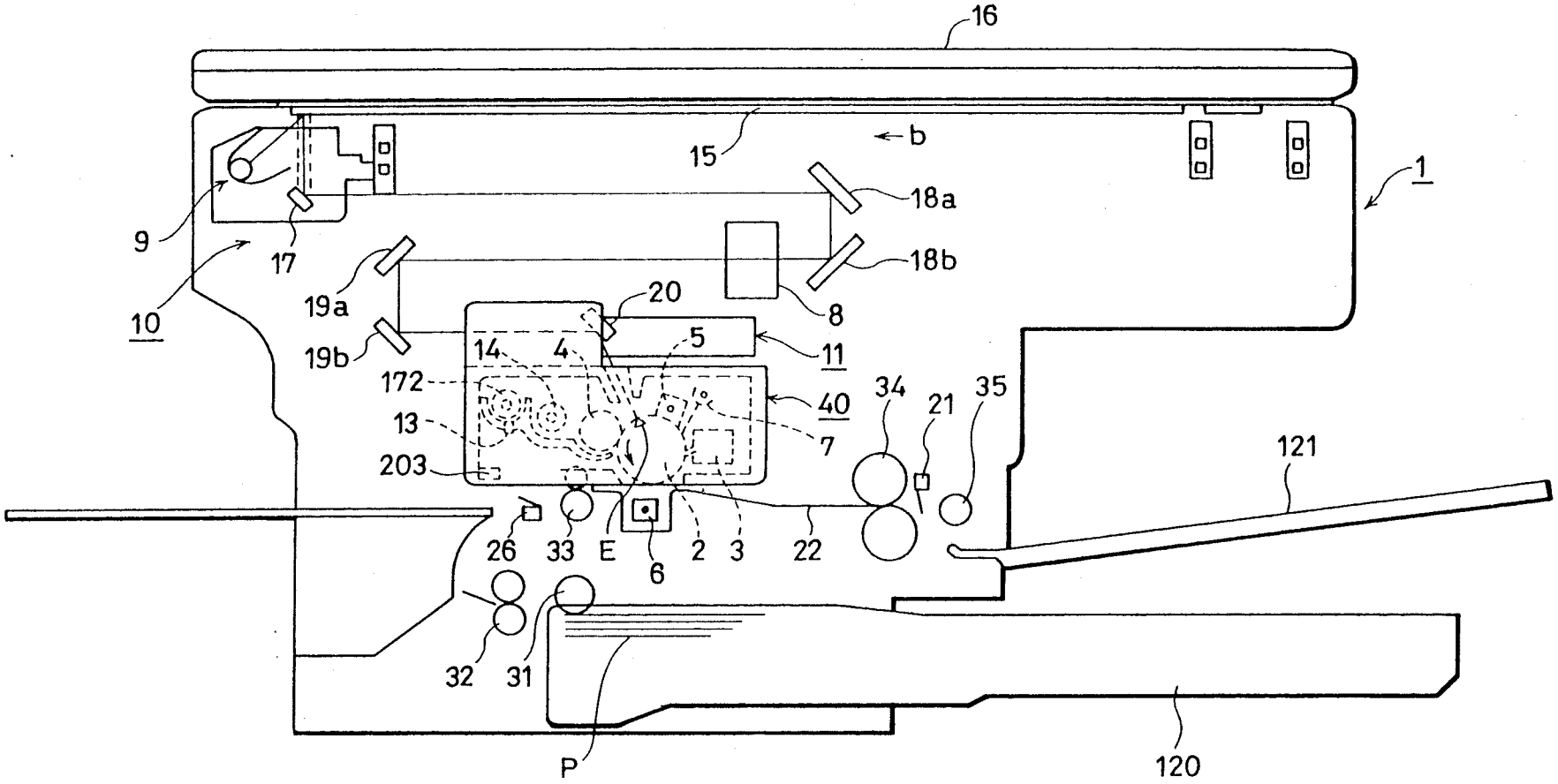
FIG. 1 is a sectional view showing structure of a copying machine, or image forming apparatus according to an embodiment of the present invention.
Figure 2:
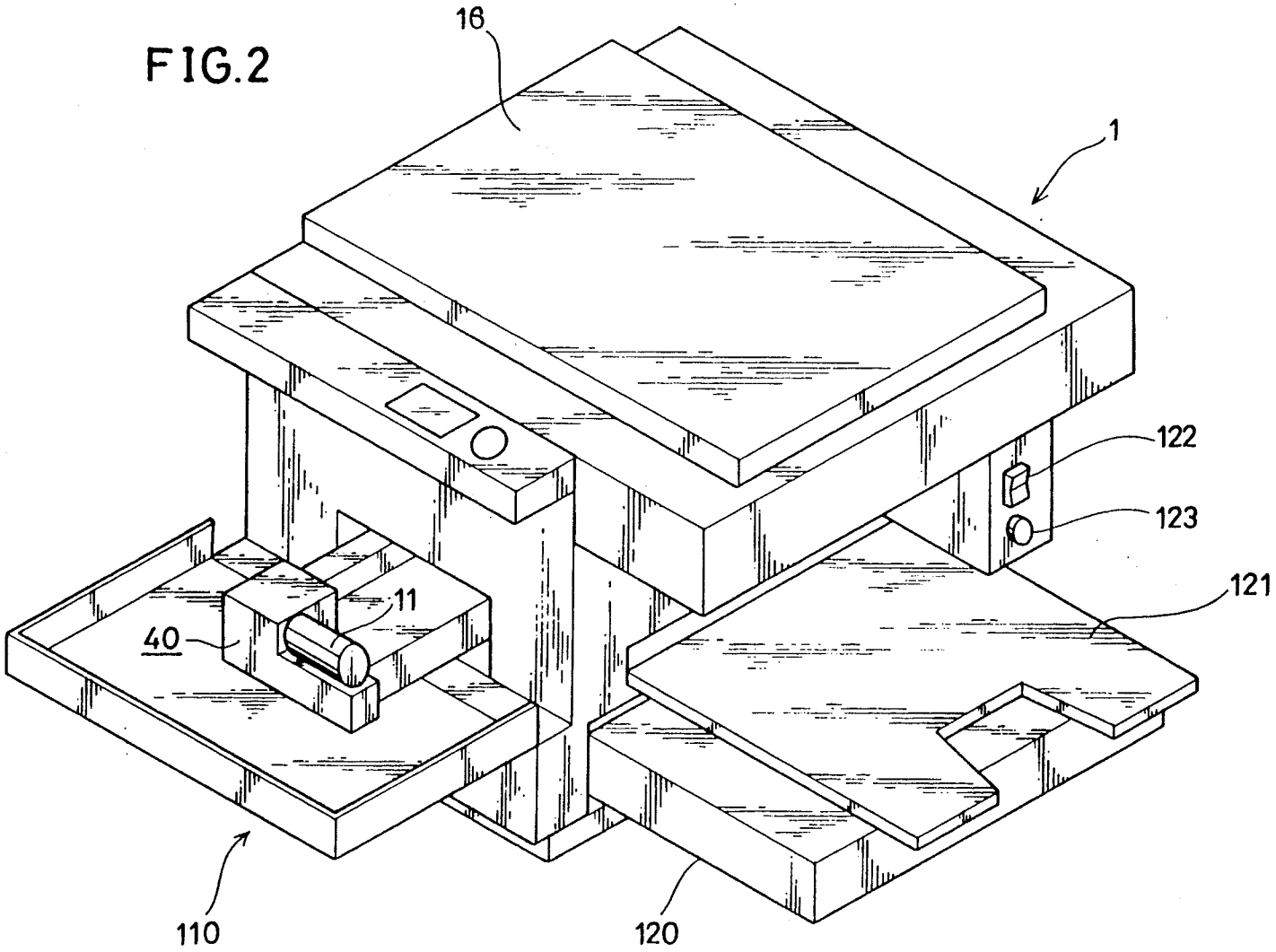
FIG. 2 is a schematic perspective view of the copying machine shown in FIG. 1, with an image forming unit being drawn therefrom.

FIG. 1 is a schematic sectional view showing internal structure of a copying machine, or image forming apparatus according to an embodiment of the present invention. FIG. 2 is a perspective view of the copying machine with its image forming unit being drawn therefrom. In the diagrams, machine body 1 has glass platen 15 provided on its upper surface. An original placed on platen 15 is scanned by optical scanning device 10 driven by an unshown scan motor, and is imaged on photoreceptor drum 2 as an electrostatic latent image.

Optical scanning device 10 is constituted of an optical system comprising exposure lamp 9, movable mirrors 17, 18*a* and 18*b*, lens 8, fixed mirrors 19*a* and 19*b* and so on. Light from the original, which has been reflected from or transmitted through these elements in the order named, irradiates photoreceptor drum 2 at a predetermined exposure position E. Meanwhile, a first slider provided with exposure lamp 9 and movable mirror 17 and a second slider provided with movable mirrors 18*a* and 18*b* are driven by the scan motor to move in the direction of arrow b. At this time, the first slider moves at a speed twice that of the second slider to scan the original. In FIG. 1, there are shown positions of the first and second sliders scanning in their maximum ranges.

On platen 15, there is provided cover 16 which is hinged along the edge on its backside and can be lifted up with the edge on its front side to expose platen 15. To copy an original, cover 16 is opened, a sheet of paper or bound sheets of a book is put on platen 15 with its original image directed downward, and then cover 16 is closed on the platen.

Further, on the front side of body 1, there is provided front cover 110 as shown in FIG. 2 which is rotatably pivoted on its underside. When the upper potion of front cover 110 is detached from/attached to body 1, body 1 is opened/closed, allowing image forming unit 40 described later to be drawn/inserted.

Further, on the right side of body 1, there are provided power switch 122 and initial switch 123 described later. Power switch 122 is a seesaw type and initial switch 123 is a push button switch which is turned on only when the machine is operating.

Photoreceptor drum 2 has a photoconductive layer on its peripheral surface, and can be driven to rotate counterclockwise as indicated by an arrow. Above photoreceptor drum 2, there is disposed sensitizing charger 5 to apply a certain potential to a surface of photoreceptor drum 2.

The circumferential speed V of photoreceptor drum 2 is constant and the travel speeds of the first and second sliders in optical scanning device 10 are V and V/2, respectively.

Downstream from exposure position E in the rotating direction of photoreceptor drum 2, there is provided a developing unit. The developing unit is constituted of developing roller 4 and first and second screws 14 and 172. The toner supplied from developer supply unit 11 is circulated between the second and first screws so as to be mixed and stirred up. The thus mixed developer is supplied from the second screw to the developing roller 4. Developing roller 4 makes an electrostatic latent image, which has been formed on a surface of photoreceptor drum 2, emerge clearly as a toner image by the magnetic brush method. Under photoreceptor drum 2, there is provided transfer charger 6. This transfer charger 6 applies an electric field to the backside of a sheet of copy paper P transported from cassette 120 as will be described later, and transfers onto the sheet of copy paper P the toner image which has been formed by developing roller 4 on the surface of photoreceptor drum 2.

Downstream from transfer charger 6 in the rotating direction of photoreceptor drum 2, there is provided cleaning device 3. Cleaning device 3 removes the toner remaining on a surface of photoreceptor drum 2 by a blade. Between cleaning device 3 and sensitizing charger 5, there is provided eraser lamp 7. Eraser lamp 7 removes charges remaining, due to the irradiated light, on a surface of photoreceptor drum 2 for the subsequent copying operation.

Further, photoreceptor drum 2, eraser lamp 7, first screw 4, second screw 172, developing roller 4, cleaning device 3 and sensitizing charger 5 are incorporated in image forming unit 40. Image forming unit 40 can be detached from body 1.

Over image forming unit 40, there is provided developer supply unit 11. Developer supply unit 11 supplies a certain amount of developer to the second screw 172. Further, in image forming unit 40, there is provided $E^2$PROM (Electrically Erasable & Programmable ROM) 203 to store information such as emptiness of toner and number of image formations. Toner concentration sensor 13 for detecting toner concentration is provided under the second screw 172. The toner concentration represents composition ratio between toner and carrier. A magnetic sensor used as toner concentration sensor 13 detects amount of carrier including magnetic substance and thus detects the composition ratio between toner and carrier.

Figure 3:
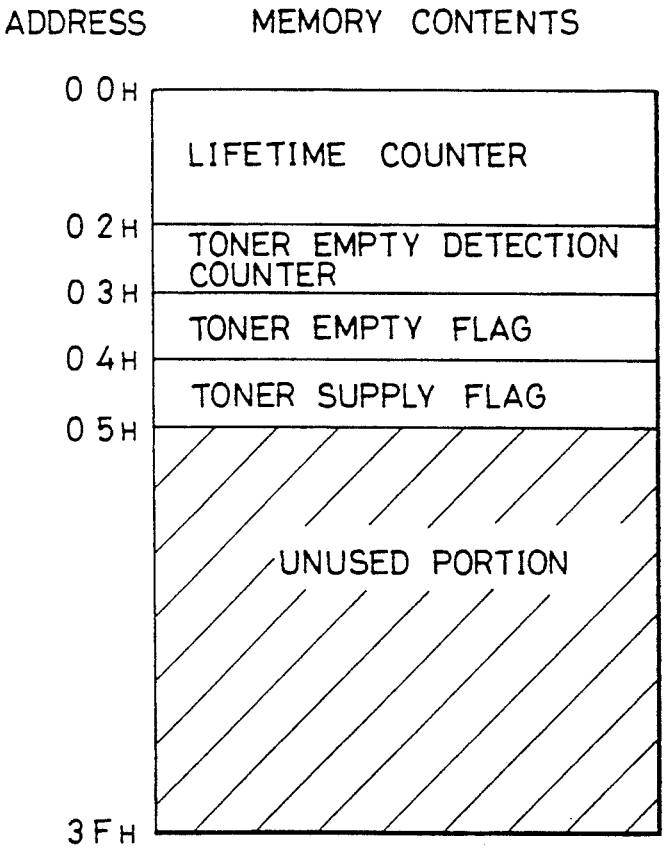
FIG. 3 is a diagram showing memory contents of an $E^2$PROM in the image forming unit shown in FIG. 2.

FIG. 3 is a diagram showing memory contents of $E^2$PROM. $E^2$PROM 203 has address space of $2^6(=3F_H)$. Address space 00 to $01_H$ is used to hold count values of an image formation counter which is incremented for every copying operation so as to detect lifetime of image forming unit 40. Address space $02_H$ is used to hold count values of a toner empty counter which counts when a toner concentration at a copying operation is below a certain value so as to detect that toner has been emptied. Address space $03_H$ is used as an area for a toner empty flag. Address space $04_H$ is used as an area for a toner supply flag indicating that additional toner must be supplied unconditionally after an exchange of toner containers 141 described later when a toner concentration is no more than 4% with the toner empty flag set. When the apparatuses are forwarded to users, some predetermined data has been stored in specific areas, based on which it is determined whether image forming unit 40 has been already used or not.

Figure 4:
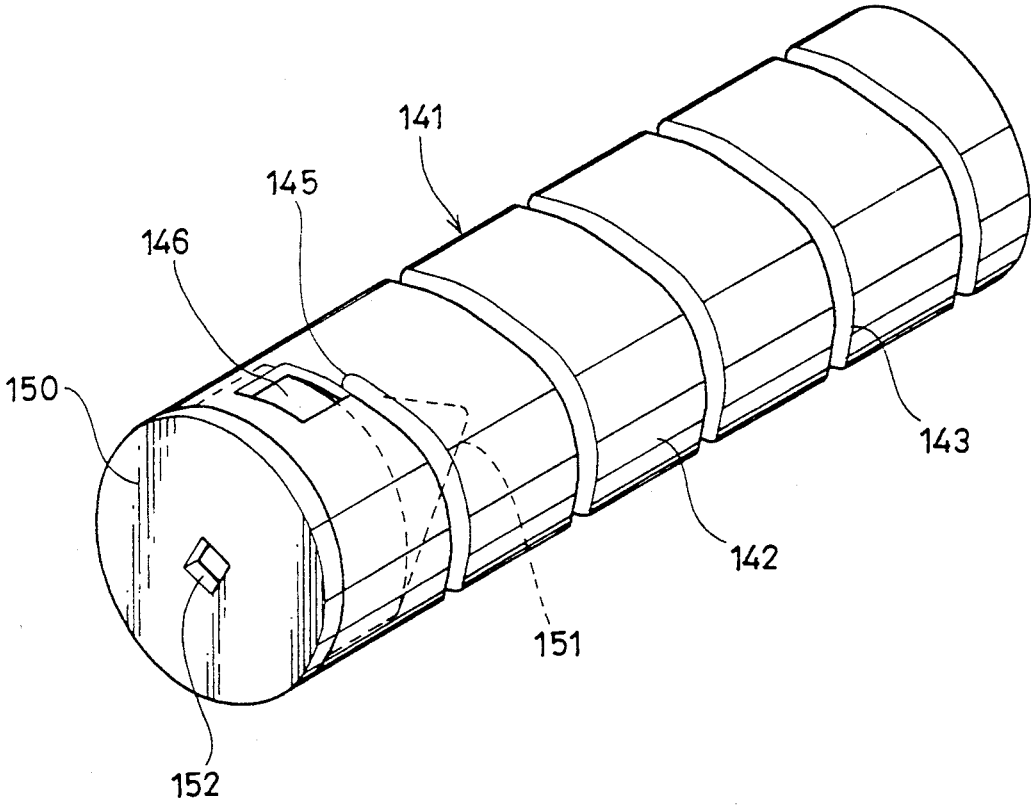
FIG. 4 is a perspective view showing structure of a developer supply unit used in the copying machine shown in FIG. 1.
Figure 5:
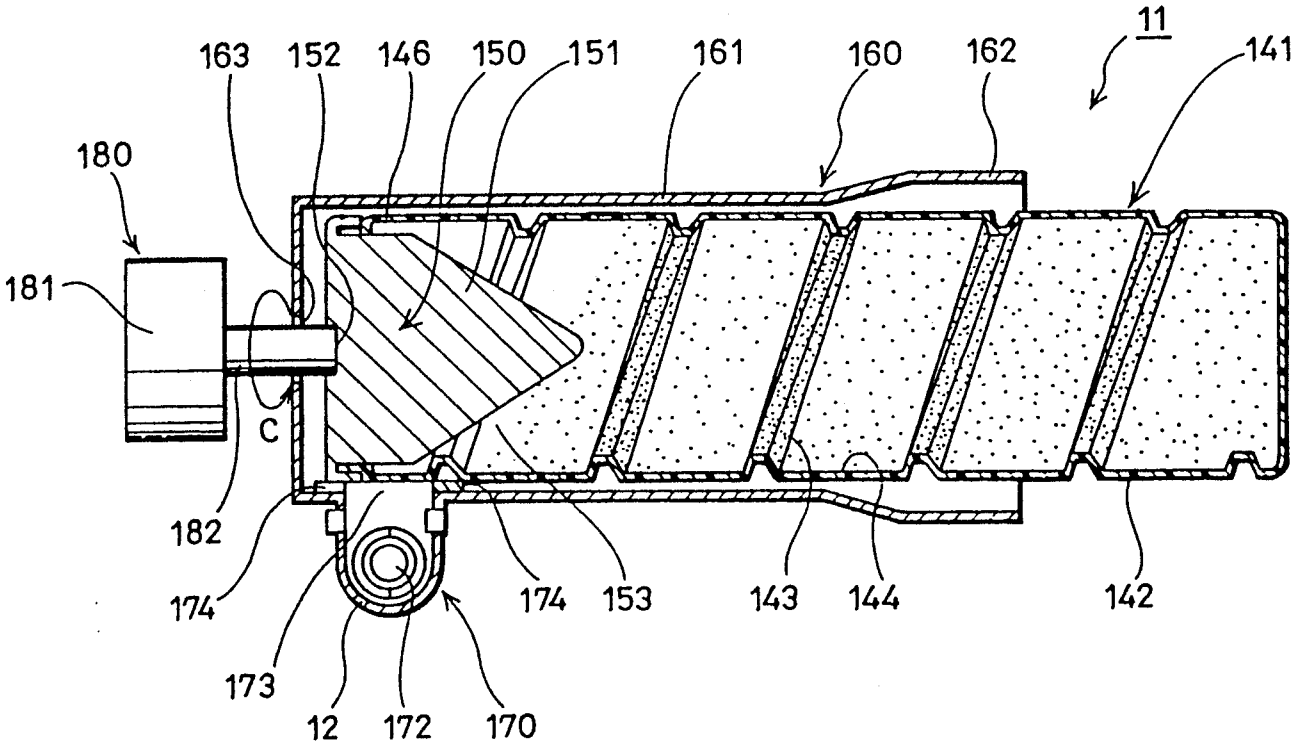
FIG. 5 is a sectional view showing structure of the developer supply unit shown in FIG. 4.

FIG. 4 is a perspective view showing structure of a developer supply unit (referred to as "toner container" hereinafter). FIG. 5 is a longitudinal sectional view showing structure of the toner container. In the diagrams, toner container 141 is comprised of cylinder 142 one end of which is opened and the other is closed, and cap 150 detachably provided on the open end of cylinder 142. Meanwhile, the other end of cylinder 142 may be covered with a cap.

Cylinder 142 is integrally formed of thermoplastic resin by blow molding and has ridge 143 formed helically along the inner surface of cylinder 142 to project inwardly. Between ridges 143, there is formed helical groove 144. Toward the open end of cylinder 142, there is provided opening 146 in the vicinity of terminal portion 145 of helical groove 144.

Cap 150 has conical restricting portion 151 which has its apex on the central axis of cylinder 142 and extends toward the closed end of cylinder 142. Cap 150 has concavity 152 at the center of its outer surface. Meanwhile, restricting portion 151 may be semi-spherical or semi-elliptic.

Toner container 141 configured as described above has its opening 146 of cylinder 142 covered with an unshown seal tape and the like and is loaded with toner before being sealed by cap 150. Meanwhile, starter, another type of developer composed of toner and magnetic carrier may be loaded instead of toner.

In FIG. 5, there are shown hold portion 160, transport portion 170 and drive portion 180 of toner container 141.

Hold portion 160 has cylinder 161 whose one end is opened. This cylinder 161 has an inside diameter little larger than the outside diameter of the above-mentioned cylinder 142. The open end of cylinder 161 has an increased inside diameter to serve as guide portion 162. Further, cylinder 161 has a hole 163 formed at the center of its closed end. Hold portion 160 is supported horizontally together with transport portion 170.

Transport portion 170 is constituted of transport conveyer 12 which accommodates one end of the second screw 172 therein and is coupled with developing unit 4 as previously described. The second screw 172 is driven by an unshown motor and the like to rotate. Furthermore, at a connecting portion between transport portion 170 and hold portion 160, there is formed opening 173. Seal members 174 and 174 are provided to inner surfaces of cylinder 161 surrounding opening 173 on its right and left sides in the diagram.

Drive portion 180 comprises motor 181, whose drive shaft 182 is inserted into hole 163 of cylinder 161.

In developer supply unit 11 configured as described above, toner container 141 has the seal tape over opening 46 stripped off, and inserted into cylinder 161 from the end having cap 150 with opening 146 on its upper side, as shown in FIG. 5. Then, drive shaft 182 engages with concavity 152 to support, together with cylinder 161, the thus inserted toner container 141.

Toner container 141 supported by hold portion 160 rotates in the direction of arrow c with the rotation of drive shaft 182 driven by motor 181.

Thus, toner in toner container 141 travels toward the side of cap 150 along helical groove 144. When it reaches a space 153 between restricting portion 151 of cap 150 and the inner surface of toner container 141 (referred to as "restricting space" hereinafter), whose sectional area is reduced as getting close to the open end, the travel of toner or developer toward the open end is restricted so that only a certain amount of toner reaches the open end.

The toner having reached the open end along helical groove 144 drops onto transport conveyer 12 through openings 146 and 173 when opening 146 is positioned downward with the rotation of toner container 141. That is, a certain amount of toner is supplied to transport conveyer 12 each time toner container 141 rotates. Then, the toner supplied to transport conveyer 12 is transported to developing unit 4 due to rotation of the second screw 172.

Meanwhile, cassette 120 shown in FIG. 1, which receives sheets of copy paper P, can be detached from body 1 and has paper supply roller 31 provided thereon. Paper supply roller 31 is driven by an unshown motor to rotate which is provided in and coupled with the roller. Copy paper P fed from cassette 120 is supplied through intermediate roller 32 to timing roller 33 to be further fed in between photoreceptor drum 2 and transfer charger 6 at certain timings.

A sheet of copy paper P having a toner image transferred thereon is fed to fixing device 34 through transport path 22. Fixing device 34 fixes the toner image on the sheet of copy paper P by heat. The sheet of copy paper P having the image fixed thereon is discharged to discharge tray 121.

Figure 6:
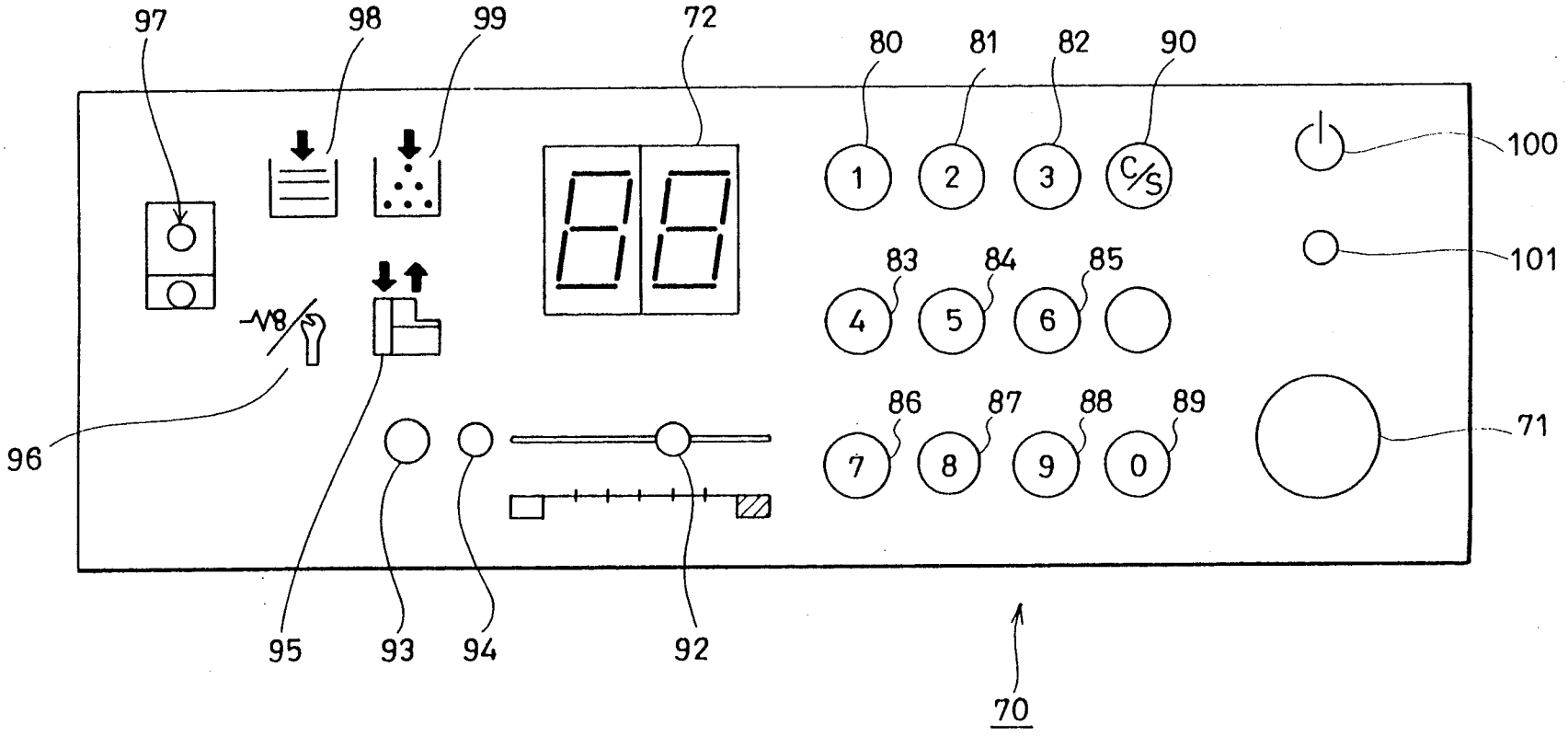
FIG. 6 is a plan view showing an operation panel of the image forming apparatus shown in FIG. 1.

FIG. 6 is a plan view showing an operation panel provided on a front portion of platen 15. On operation panel 70, there are disposed print key 71 for starting a copying operation at its right corner and display 72 for indicating number of copies at its center, which is comprised of two LEDs having 7 segments.

Ten-key 80 to 89 arranged on the right side of print key 71 is used mainly for inputting number of copies. Clear stop key (C/S key) 90 is used to cancel registered numbers and suspend copying operation. Further, the concentration of a copied image can be continuously set by exposure volume 92 arranged below display 72. On the left side of exposure volume 92, there are disposed automatic/manual exposure key 93 for selecting either automatic or manual exposure, and LED 94, which is lighted when the automatic exposure has been selected.

On the upper side of automatic/manual exposure key 94, there is disposed LED 95 for indicating, based on lifetime (=number of image formations) of image forming unit 40, that an exchange of image forming units is required. Further, on the left side of LED 95, there is disposed display LED 96 for indicating that jamming or other failure is taking place. On the upper side of display LED 96, there are disposed paper empty LED 98 for indicating that there remains no copy paper P in cassette 120, and toner empty LED 99 for indicating that toner container 141 has been emptied. On the left side of those LEDs described above, there is provided jamming display 97 for indicating a jamming portion, which is represented as either body 1 or cassette 120. Furthermore, on the upper side of print key 71, there are disposed copy inhibit LED 100 for indicating that copying is inhibited while jamming and the like is taking place, and copy wait display LED 101 for indicating that copying is waiting during warming-up, a fast toner supply mode and the like.

Figure 7:
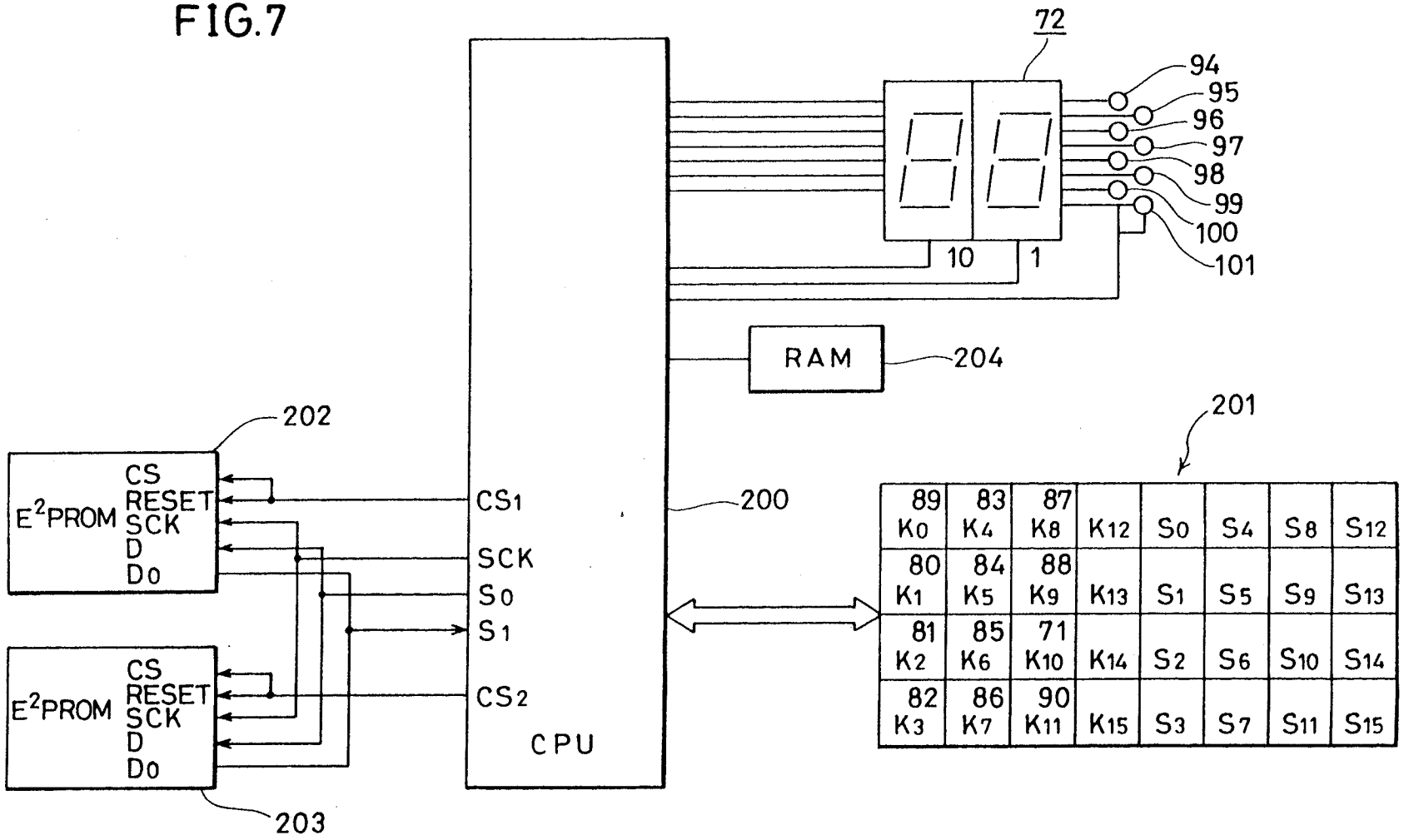
FIG. 7 is a block diagram showing structure of a control circuit in the image forming apparatus shown in FIG. 1.

FIG. 7 is a block diagram showing structure of a control circuit in a copying machine according to an embodiment of the present invention, which comprises microcomputer (referred to as "CPU" hereinafter) 200 for controlling the copying machine. CPU 200 is connected to switch matrix 201 constituted of a group of keys on operation panel 70 and switch portions of various sensors, display portion 72 for indicating number of copies and various display LEDs 94 to 101. Further, CPU 200 has an output port for controlling copying and scanning operations, which is connected to drive circuits (not shown) of the respective elements such as main motor 27, unshown developing motor and timing roller clutch, sensitizing charger 5 and transfer charger 6. Furthermore, chip select terminals CS1 and CS2, serial clock terminal SCK, data input/output terminals SI and SO are provided on the machine body and connected to corresponding terminals of $E^2$PROM 202 which stores information of modes, number of copies and the like, and of $E^2$PROM 203 provided in image forming unit 40 to store information indicating state of image forming unit 40. Furthermore, CPU200 is connected to RAM 204 which temporarily stores control programs of body 1 and flags indicative of states of body 1.

Now, referring to flow charts shown in FIGS. 8 to 16, control procedure of CPU 200 will be described. Meanwhile, before those flow charts are described, the terms "on edge" and "off edge" used therein will be defined below.

"On edge" is defined as representing a changing state which appears when switches, sensors, signals and the like change from the off-state to the on-state.

"Off-edge" is defined as representing a changing state which appears when switches, sensors, signals and the like change from the on-state to the off-state.

Figure 8:
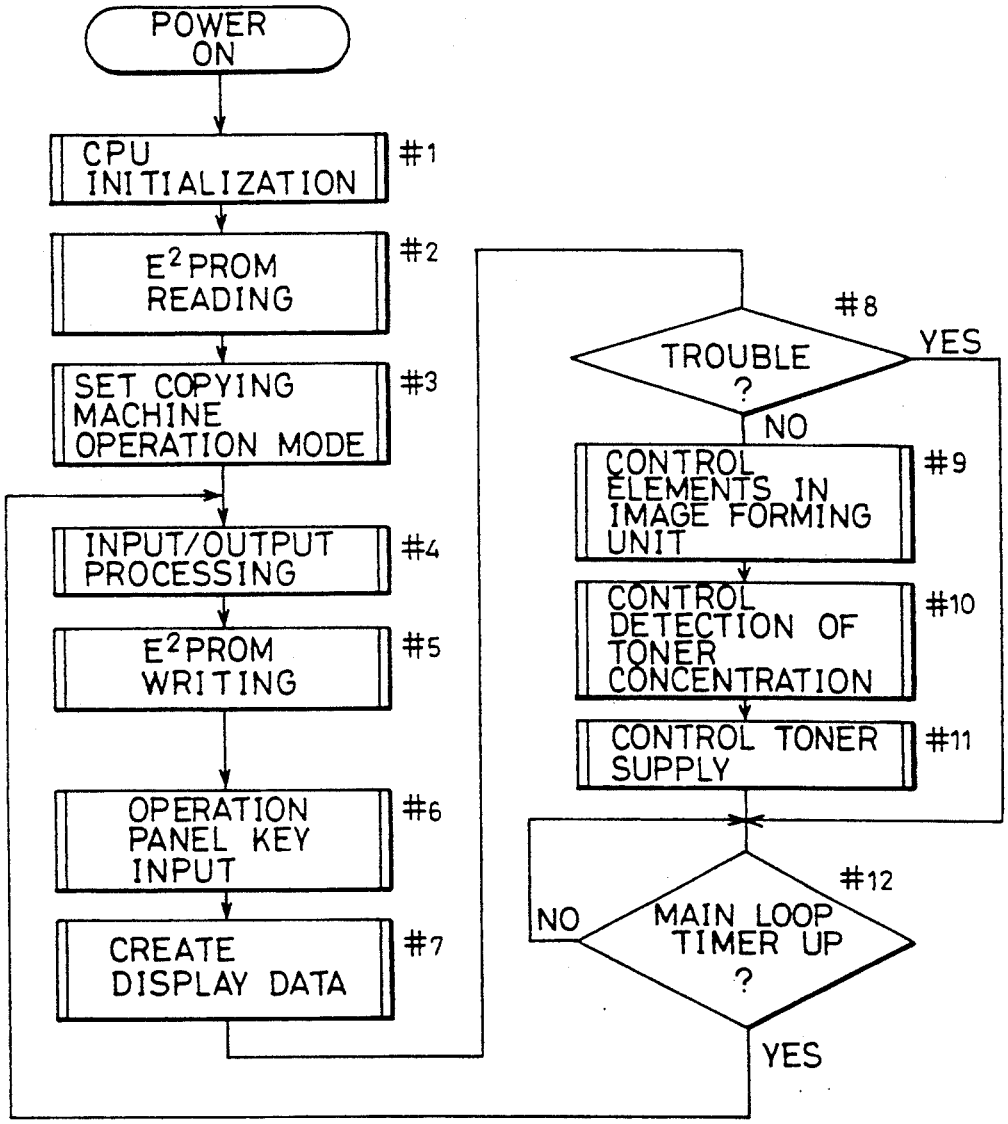
FIG. 8 is a flow chart diagram showing the main routine executed by the CPU shown in FIG. 7.

FIG. 8 is a flow chart diagram showing the main flow of CPU 200, along which the entire operation will be described briefly.

First, when power is turned on, CPU 200 is initialized (step #1). Subsequently, data is read out of $E^2$PROMs 202 and 203 (step #2). More specifically, connections to $E^2$PROMs 202 and 203 are checked and data stored in $E^2$PROMs 202 and 203 is read out. When the reading from $E^2$PROMs is completed, operation mode of the copying machine is set based on the data read out of $E^2$PROMs 202 and 203 (step #3). For example, when image forming unit 40 has not been used yet, specific data stored in a predetermined area of $E^2$PROM 202 is detected to set a developer (starter) set mode.

Subsequently, determinations are made as to whether various input/output switches have been turned on or not (step #4) which are used for input processing where states of various keys and switches on operation panel 70 connected to outside of CPU 200, and several sensors are read, A/D input processing where levels at analogue input terminals of CPU 200 are read, output processing where levels of output terminals of CPU 200 are set, and the like. Thereafter, subroutines to read from and write to $E^2$PROMs 202 and 203 are executed (step #5). The reading/writing processing to and from $E^2$PROMs 202 and 203 are done when required in each control program. After this processing is completed, operation panel key input processing is performed at step #6 to identify inputs through the keys on operation panel 70 and make processings corresponding to the respective keys. More specifically, at step #6, doubly depressed states of the operation switches on the operation panel are identified and further it is determined which key input is accepted as effective. Thereafter, processings corresponding to the effective key inputs are made.

At step #7, display data for setting contents of display 72 on operation panel 70 is created. When all the data is created, it is examined whether a trouble such as jamming in machine body 1 and abnormal temperatures at fixing device 34 has occurred or not (step #8). When some trouble has occurred, the following control is not performed but the apparatus waits until a time set for the main routine has passed. When no trouble has occurred, control is made on respective elements such as photoreceptor drum 2 and developing unit 4 in image forming unit 40 (step #9). Meanwhile, in this subroutine, when a determination is made in the $E^2$PROM initial setting subroutine (step #2) that image forming unit 40 has been already used, control is made to set developer. Thereafter, concentration of toner is detected and the detection of toner concentration is controlled to control the concentration at predetermined timings in a copying cycle (step #10). Subsequently, the normal subroutine for controlling toner supply is executed, where toner is supplied when the toner concentration becomes low (step #11).

At step #12, determination is made as to whether a predetermined time corresponding to one loop of the main routine has passed or not. The operation waits until the time has passed and then returns to step #4.

In the following, only those parts of the respective subroutines that are related to the present invention will be described.

Figure 9:
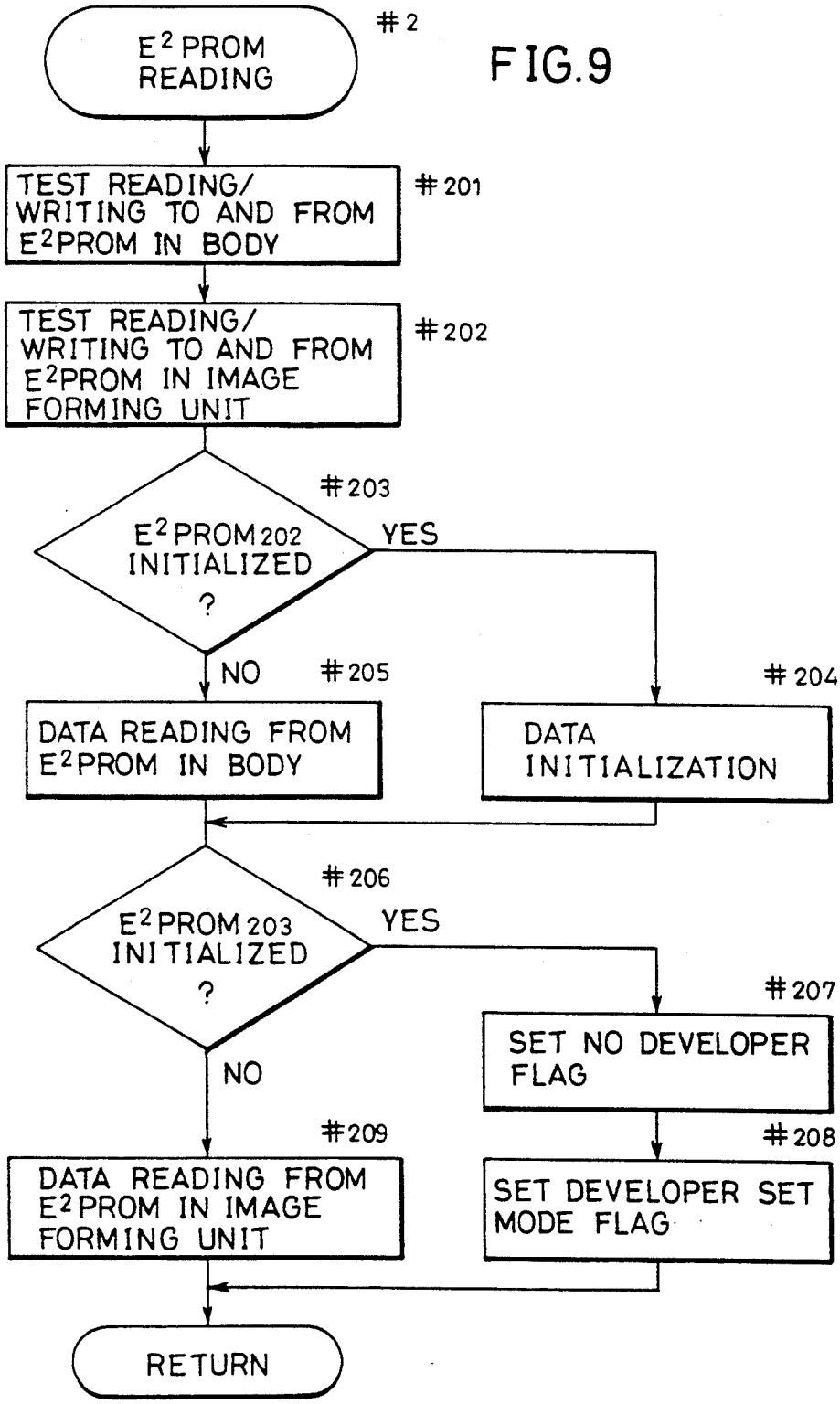
FIG. 9 is a flow chart diagram showing specific contents of the $E^2$PROM reading subroutine shown in FIG. 8.

FIG. 9 is a flow chart diagram showing procedure of the subroutine of reading from $E^2$PROM at step #2.

First, writing and reading to and from a predetermined address of $E^2$PROM 202 in body 1 are tested (step #201). Subsequently, writing and reading to and from a predetermined address of $E^2$PROM 203 in image forming unit 40 are tested (step #202). In these tests, it is detected whether or not an abnormal state of connection exists between $E^2$PROMs 202 and 203. Thereafter, data is read out of a second address different from the above-mentioned address in $E^2$PROM 202 (for example, address of the image formation counter) and based on contents of the read-out data, the initial state of $E^2$PROM 202 is checked (step #203). When $E^2$PROM 202 is in its initial state, initial data is written in $E^2$PROM 202 at step #204. When $E^2$PROM 202 is not in the initial state, data of various modes and flags stored in E²PROM 202 are read out and written in RAM 204 (step #205). Likewise, as in step #203, the initial state of E²PROM 203 in image forming unit 40 is checked (step #206). When E²PROM 203 is in its initial state, a no developer flag is set (step #207), a developer set mode flag is set (step #208) and then the operation returns to the main routine. That is, it is detected by identifying data written in E²PROM 203 that the image forming unit 40 has not been used yet. When the unit has not been used yet, the respective flags are set at steps #207 and #208 so as to supply developer to developing unit 4 as starter. On the other hand, when E²PROM 203 is not in the initial state, information such as lifetime of developing unit 4 and the toner empty flag stored in E²PROM 203 is read out and written in RAM 204 (step #208), then the operation returns to the main routine.

Figure 10:
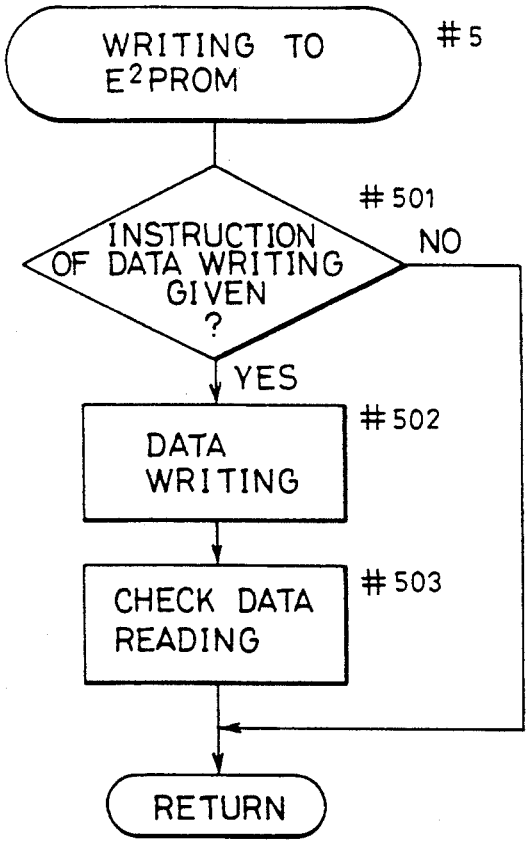
FIG. 10 is a flow chart diagram showing specific contents of the $E^2$PROM writing subroutine shown in FIG. 8.

FIG. 10 is a flow chart diagram showing the subroutine of reading/writing to and from E²PROM. When instructions of data writing are given in each control program, the instructions are detected and data is written in (steps #501 to #503). Thereafter, the written data is read out again to be compared with those data for writing and thus, whether the writing has been correctly performed or not is checked.

Figure 11:
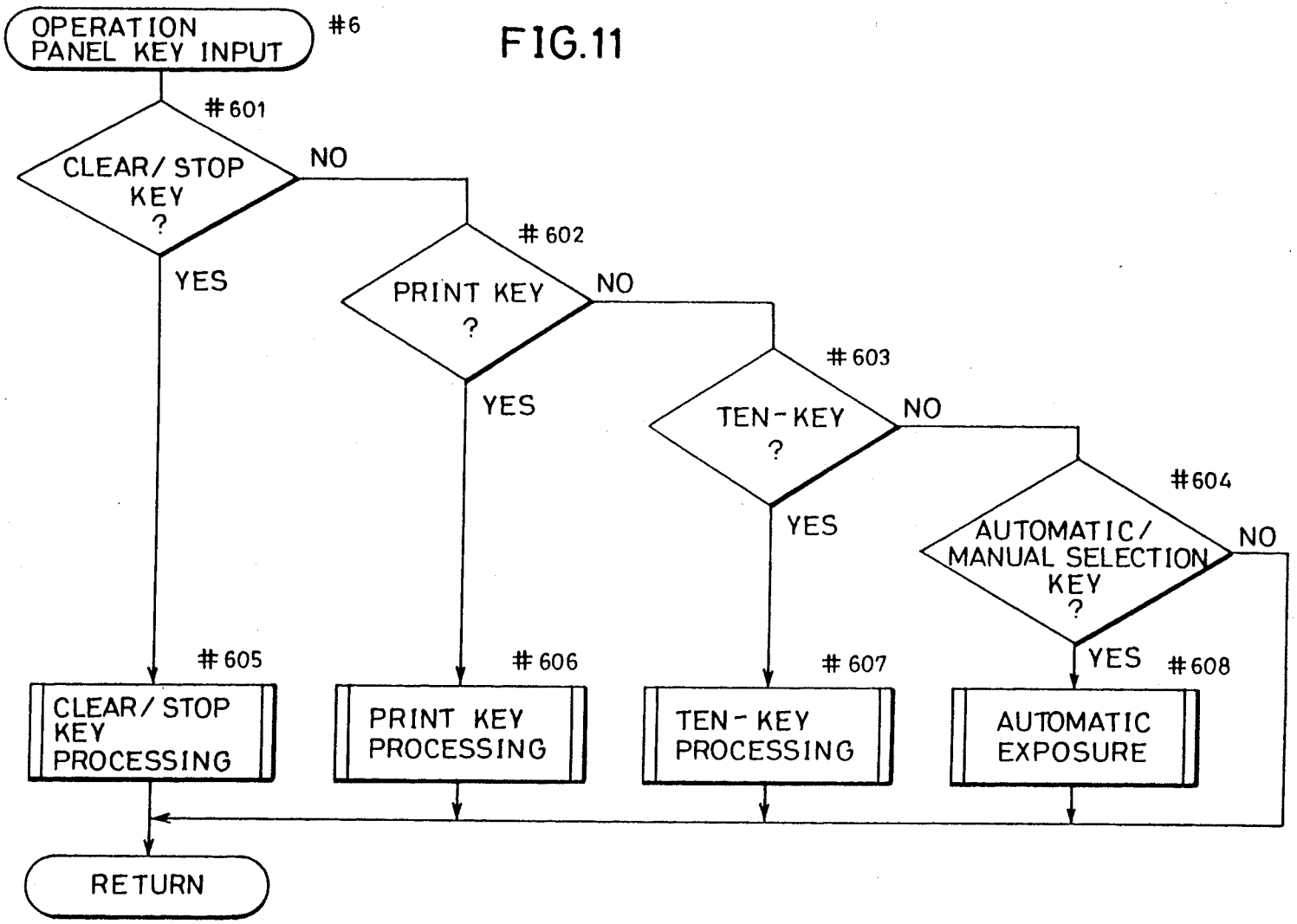
FIG. 11 is a flow chart diagram showing specific contents of the operation panel key input processing shown in FIG. 8.

Subsequently, the key input processing (step #6) using the keys arranged on panel 70 will be described. FIG. 11 is a flow chart diagram showing the subroutine of input processing using the operation panel keys.

First, input through clear/stop key 90 is checked at step #601. When an input has been made through clear/stop key 90, a subroutine of clear/stop key processing is executed at #605 and operation returns to the main routine. When no input has been made through clear/stop key 90, input through print key 71 is checked at step #602. When an input has been made through the key, print key processing is made at step #606, while when no input has been made through the key, input through ten-key 80 to 89 is checked. When an input has been made through the ten-key, ten-key processing is made at step #607. When no input has been made through the ten-key, input through automatic/manual exposure selection key 93 is checked at step #604. When an input has been made through the key, automatic exposure processing is made, while when no input has been made through the key, the operation returns to the main routine.

Figure 12:
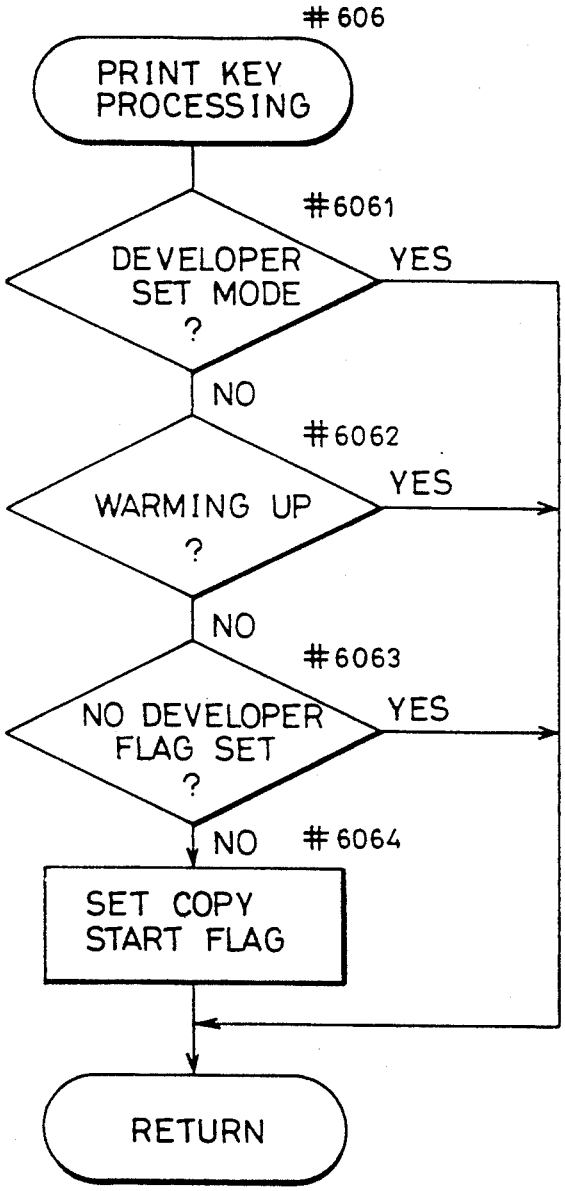
FIG. 12 is a flow chart diagram showing specific contents of the print key processing shown in FIG. 11.

Further, in the subroutine of print key processing (step #606) in the operation panel key input processing, as shown in the flow chart diagram of FIG. 12, determinations are made as to whether developer set mode has been set or not, or whether image forming unit 40 has not been used and therefore, needs supply of developer or not, and as to whether fixing device 34 is being warmed up or not by heating and the like at steps #6061 and #6062, respectively. When the developer set mode has been set or the fixing device is being warmed up, the operation immediately returns to the subroutine of input processing using the operation panel keys and does not allow copying. Further, the no developer flag is checked at step #6063. Also when the flag has been set, or there is no developer, copying is not allowed. Except in those cases, the copy start flag is set at step #6064 and an instruction to start copying is given.

Figure 13:
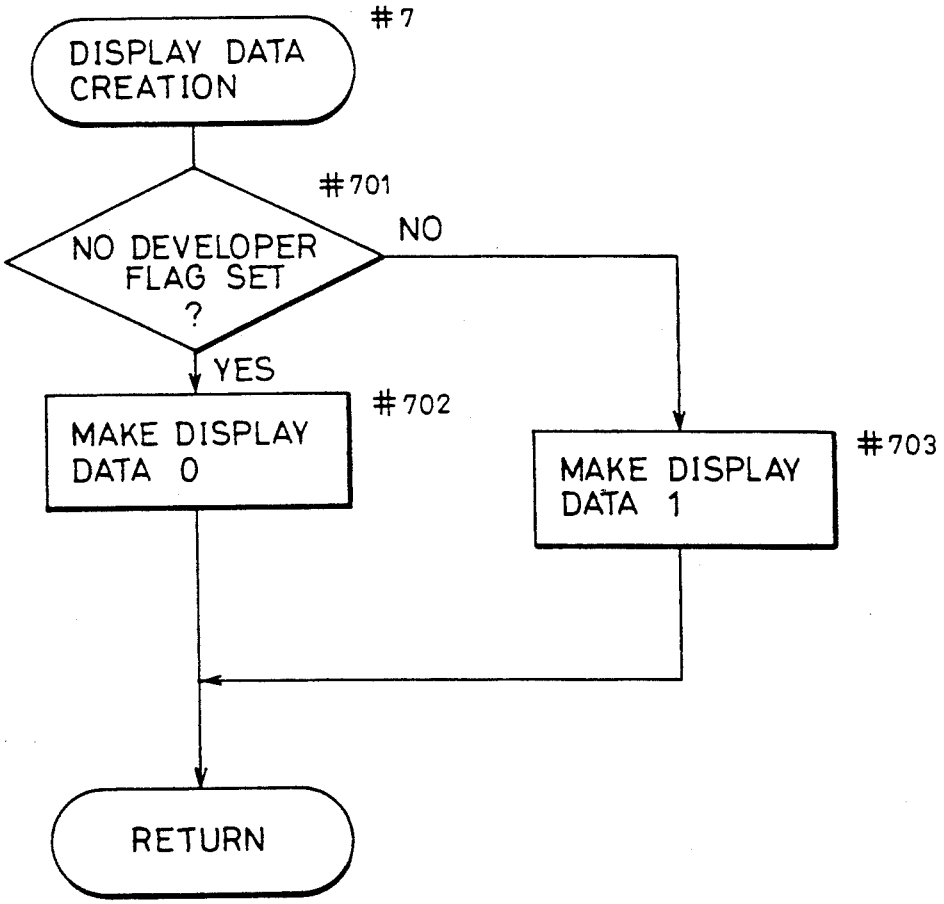
FIG. 13 is a flow chart diagram showing specific contents of the display data creating routine shown in FIG. 8.

Subsequently, the subroutine for generating display data will be described. FIG. 13 is a flow chart diagram showing the subroutine.

First, it is determined at step #701 whether the no developer flag has been set or not. When this flag has been set, the display data shown by display 72 is set to "0", while when this flag has not been set, the same is set to "1", and the operation returns to the main routine.

Further, procedure for controlling the components in the image forming unit will be described. FIGS. 14A to 14F are flow chart diagrams showing the subroutine. In this subroutine, control is made on the components in the image forming unit according to 18 states $0_H$ to $33_H$.

In state $0_H$, it is determined whether copying is to be started or not according to the subroutine for checking copy start as will be described later (#801). When copy start is allowed, state of $1_H$ is set and the timing roller is stopped (#802). Further, a timer for turning on the main motor is set (#803). Further, when it is determined in the subroutine for checking copy start that the developer start mode has been set, the state is set to $30_H$. Next, in state $1_H$, starting of the main motor is controlled (#811 to 813). In state $2_H$, transfer charger 6 and exposure lamp 9 are turned on and paper feed by paper feed roller 31 is allowed (#821 to 825).

In state $3_H$, it is ensured that paper is supplied (#831 to 835). In state $4_H$, a timer for scanning start is set (#841 to 843). Further, in state $5_H$, sensitizing charger 5 is turned on and a toner concentration check flag is set (#851 to 854). In state $6_H$, the trailing edge of a sheet of copy paper being fed to transfer charger 6 is detected (#861 to 864). In state $7_H$, end of scanning operation is ensured after a time set in the timer has passed and sensitizing charger 5 is turned off (#871 to 874). In state $8_H$, after the completion of scanning is ensured, a scan end flag is reset and exposure lamp 9 is turned off (#881 to 886).

In state $9_H$, a copy stop is checked according to a copy stop check subroutine as will be described later (#891). When copying is to be stopped, or when a carry flag has been set, exposure lamp 9 is turned off (#895). If copying is not to be stopped, or when the carry flag has been set, determination is made as to whether scanning has been completed or not (#892). When the scanning has not been completed, exposure lamp 9 is turned on (#893). Then, the operation turns back to state $3_H$ (#894) to perform the subsequent scanning. In states $A_H$ to $D_H$, various processings for stop are made. Especially in state $A_H$, when optical scanning device 10 is at home position (right side in FIG. 1) (#1101), and in state $C_H$, until the main motor stops (NO at #1101), start of copying is checked according to the copy start check subroutine shown in FIG. 12 and thus the copying operation is always monitored.

Figure 14A:
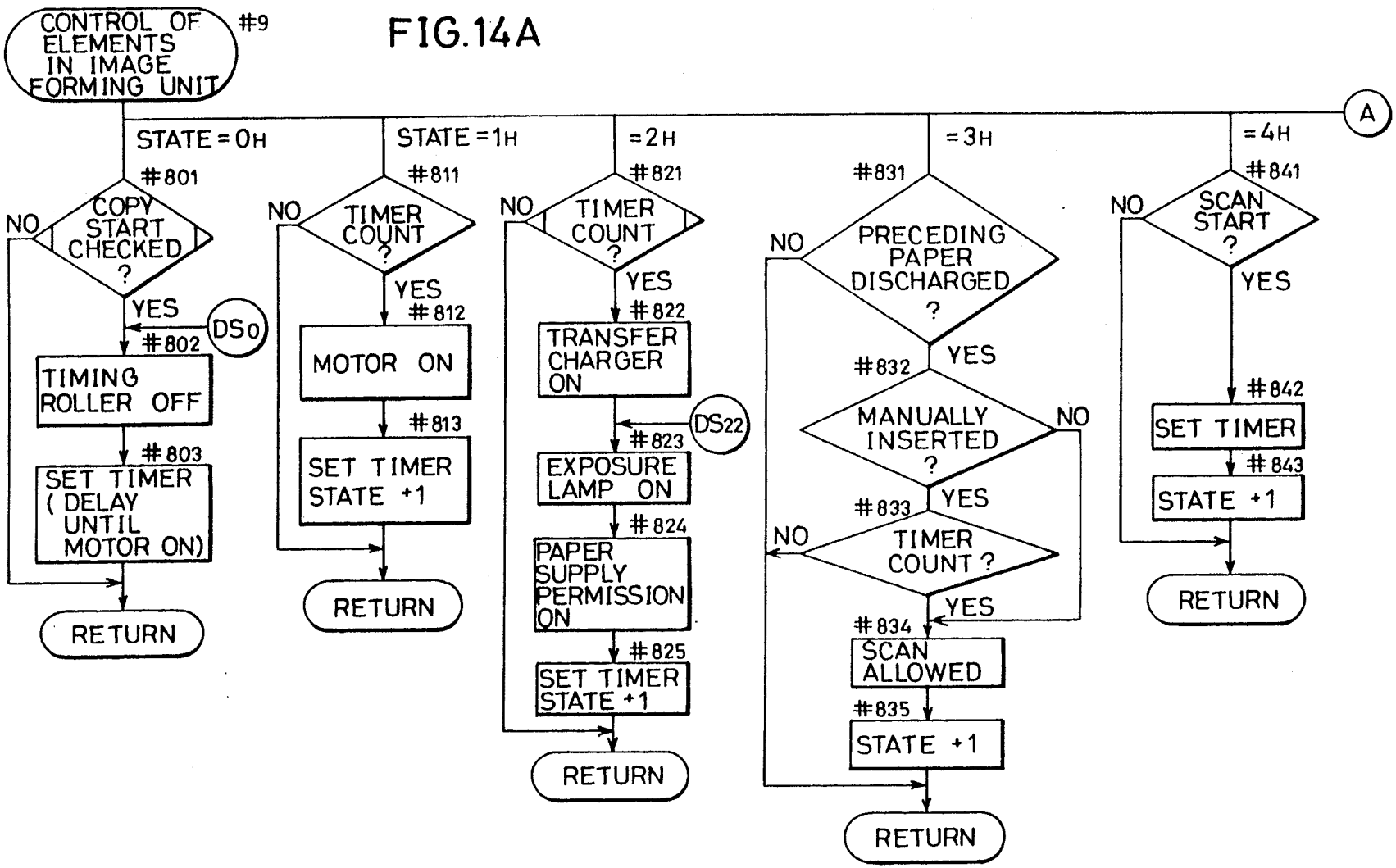
FIGS. 14A to 14F are flow chart diagrams showing specific contents of the subroutines for controlling the components in the image forming unit shown in FIG. 8.
Figure 14B:
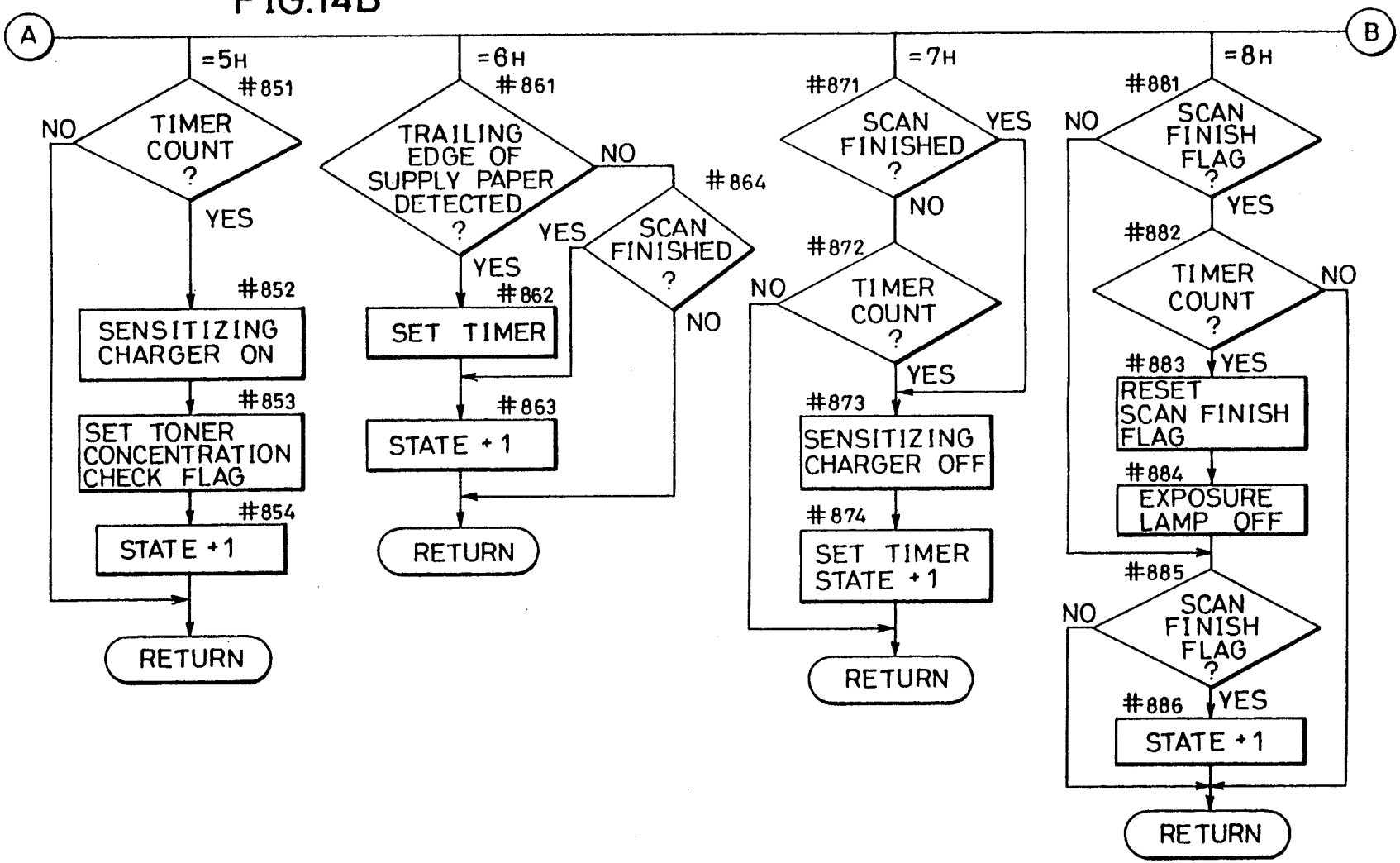
Figure 14C:
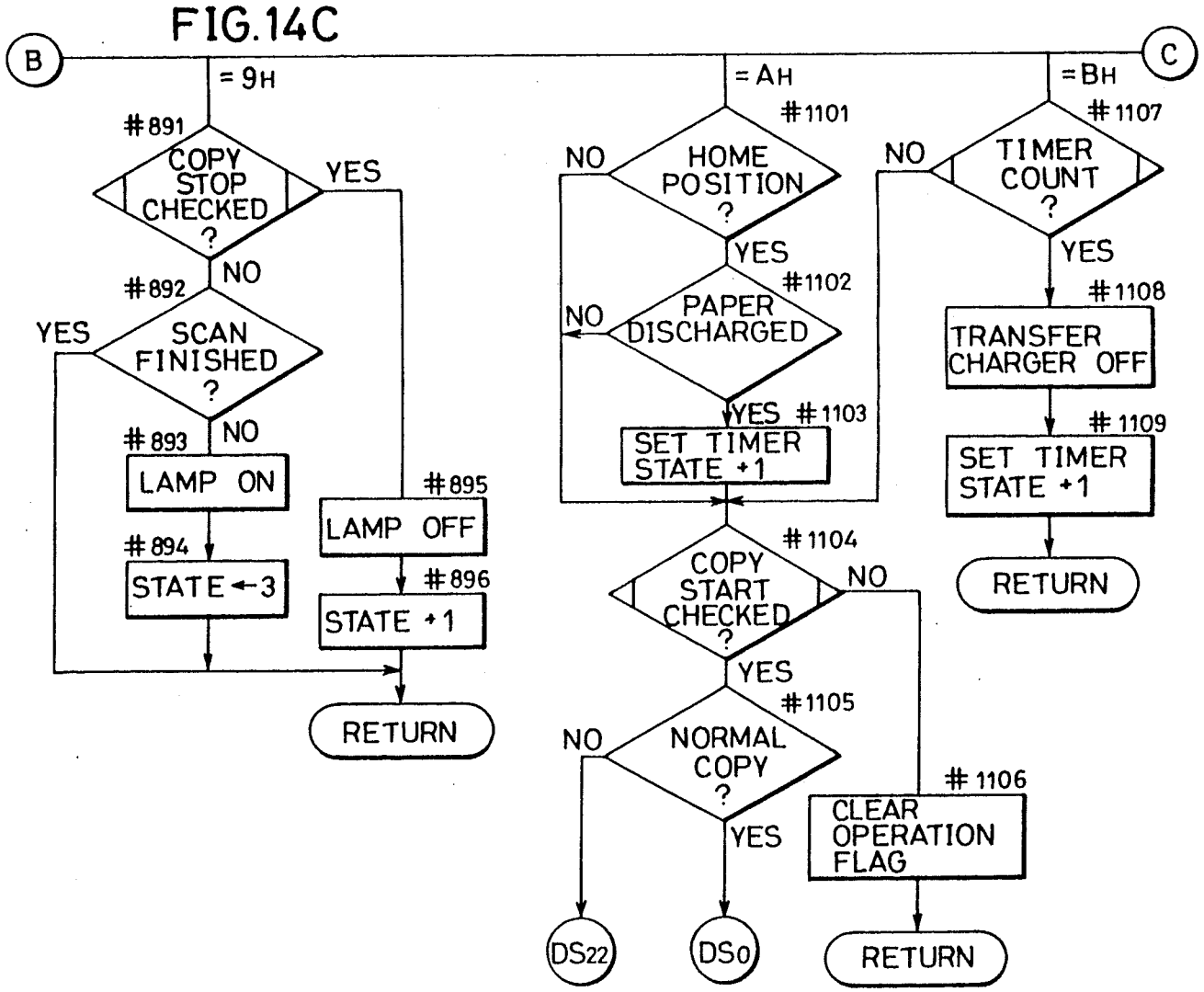
Figure 14D:
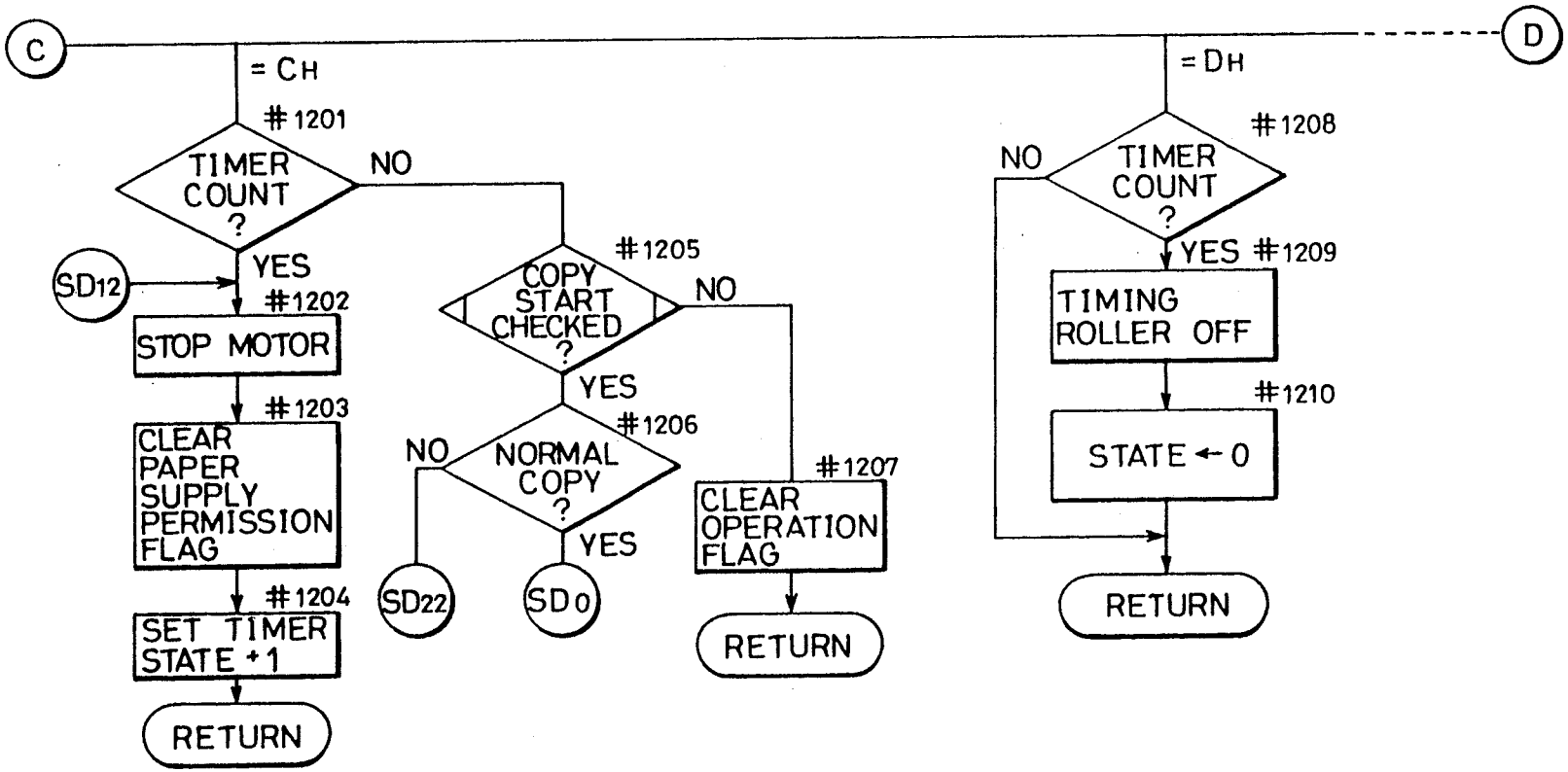
Figure 14E:
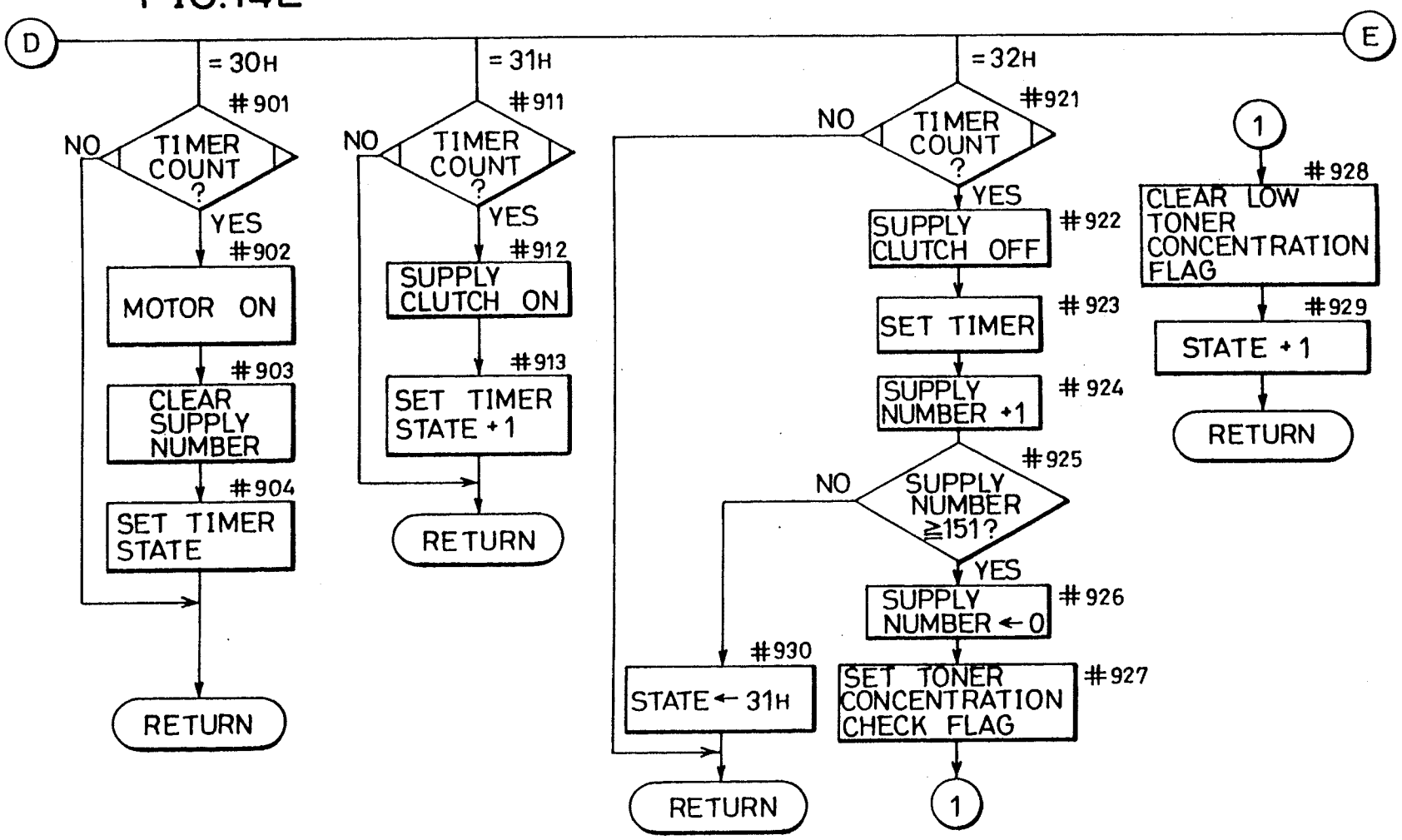
Figure 14F:
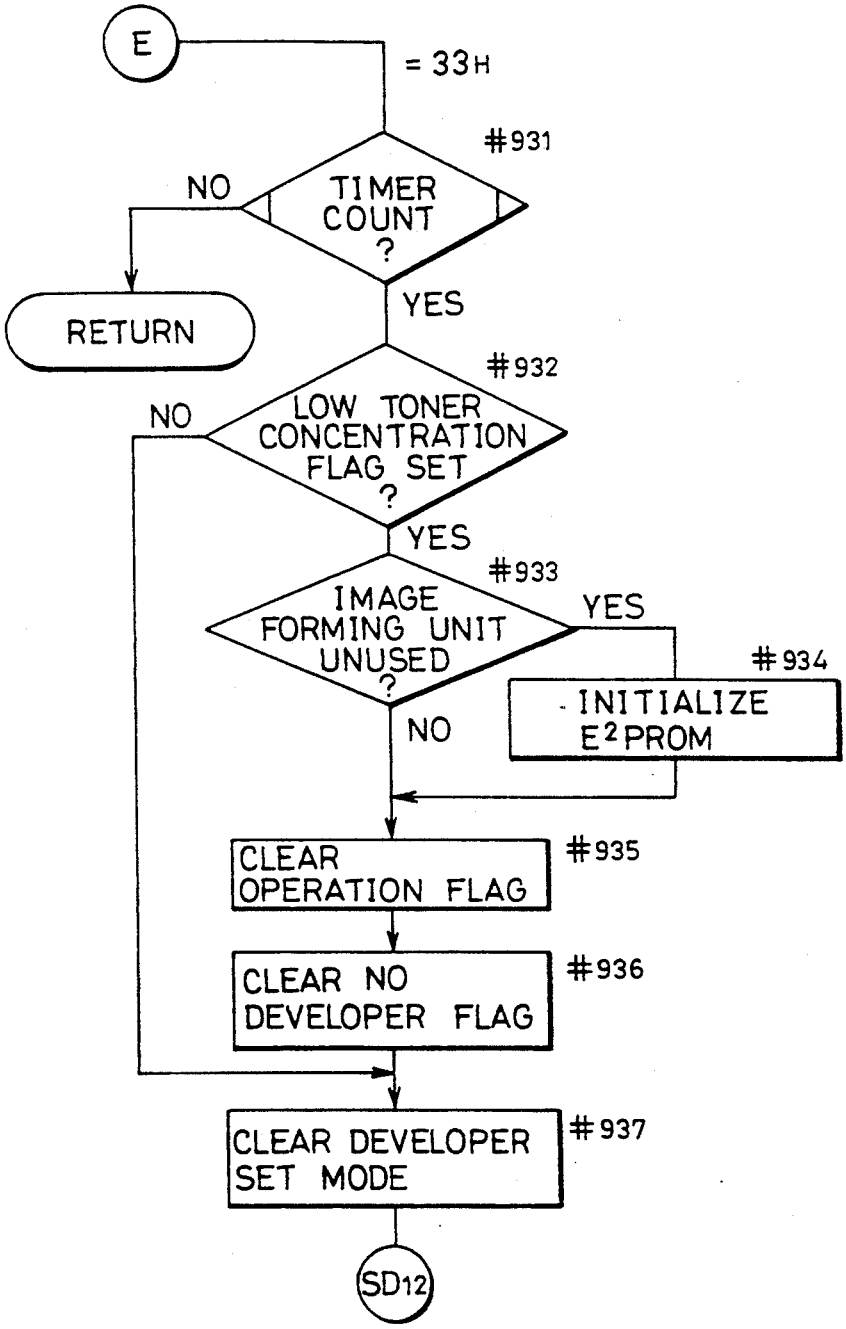
Figure 15:
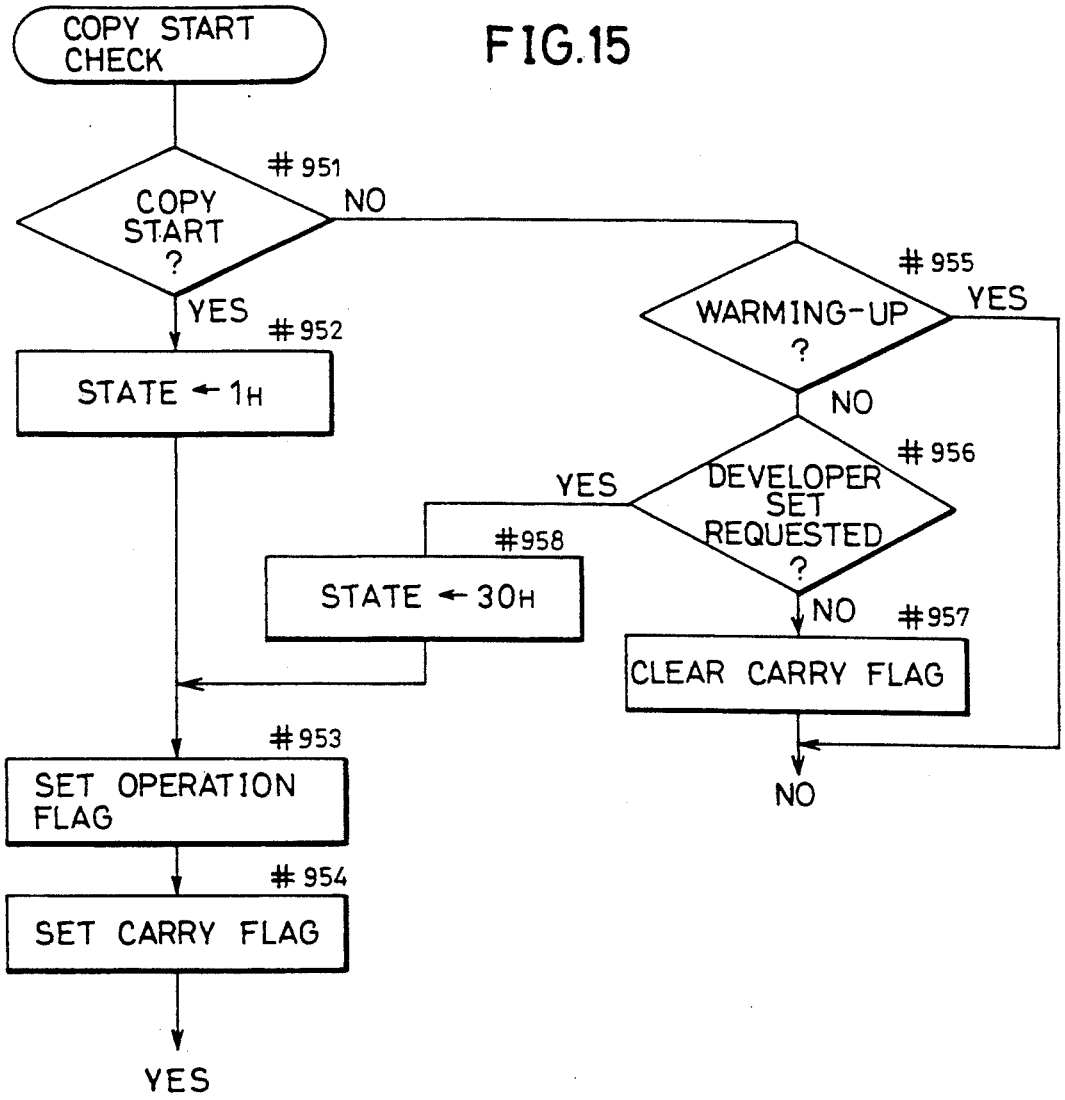

FIGS. 14E and 14F are flow charts diagrams concerning the developer set mode in which subject matter of the present invention is included. When the developer set mode is detected, supply motor 181 is turned on (step #902) after a predetermined time has passed at step #901 in state $30_H$. Then, the supply number is cleared to show 0 (step #903), a timer for an unshown supply clutch is set, and the state is incremented by one (step #904). In state $31_H$ after a predetermined time has passed at step #911, the clutch coupled with motor 181 is turned on (step #912), a timer for determining the operation time of the clutch is set, and the state is incremented by one (step #913). In state $32_H$ after a predetermined time has passed (step #921), the supply clutch is turned off (step #922), the stirring time of the second screw 172 is set (step #923), and then the supply number is incremented by one (step #924). Thereafter, it is checked whether the supply number has become larger than 151 or not (step #925). When the supply number has become larger than 151, the supply number is set to 0 (step #926), the toner concentration check request flag is set (step #927), the no toner concentration flag is reset (#928) and then the state is incremented by one (step #929). When the supply number is below 151, the state is set to $31_H$ (step #930) and the supply operation is repeated.

Next, in state $33_H$, if a predetermined time has not passed at step #931, the operation returns to the main routine. This timer determines the time taken for the toner concentration check to be finished. When this timer is counted up, the low toner concentration flag is checked step #932). Generally, the low toner concentration flag is set when the toner concentration is below 6%. However, especially in the developer set mode, the low toner concentration flag is set when the toner concentration is below 10%. That is, when the toner concentration in developing unit 4 is below 10% after developer has been set based on a predetermined supply number, it is determined that the developer setting operation has been normally performed. As described above, the setting state of developer, or presence or absence of developer is determined indirectly by toner concentration sensor 13 in the present embodiment.

When the toner concentration is lower than 10%, determination is made as to whether image forming unit 40 is in the initial state or not, or whether it has been already used or not (step #933). This determination is made based on the contents of data stored at a predetermined address in $E^2$PROM 203. If the image forming unit has not been used yet, the data in $E^2$PROM 203 is initialized (step #934). On the other hand, when the image forming unit has been already used, $E^2$PROM 203 is not initialized since it is considered that $E^2$PROM 203 has been already initialized and this is an operation performed in the developer set mode after developer has been changed. Subsequently, the operation flag indicating that the apparatus is operating is cleared at step #935, the no developer flag is cleared at step #936, and further the developer set mode flag is cleared so as not to allow any operation in the developer set mode (step #937). Thereafter, the operation proceeds to a motor stop operation in state $C_H$ in FIG. 14D.

Further, when the low toner concentration flag has not been set at step #932, it is determined that developer has not been supplied and thus, the operation skips step 937. This makes the developer set mode stop and inhibits the subsequent copying. This is because the copy start flag can not be set as long as the no developer flag has been set at step #6063 in FIG. 12.

Meanwhile, in the present embodiment, the count value of an image formation counter of $E^2$PROM 203 in image forming unit 40 is initialized to represent 0 after the setting of developer has been ensured. Since the counter is automatically cleared in this manner, the count value can be reliably cleared without causing any error, as compared with the manner using a reset switch.

Meanwhile, the image formation counter may be initialized by setting any lifetime value as the count value, and making the counter count down for every copying operation. In such a case, an end of the lifetime is determined when the count value reaches 0.

Subsequently, the copy start check subroutine which is executed in the above-mentioned states $0_H$, $A_H$ and $C_H$ will be described. In the copy start check subroutine shown in FIG. 15, a copy start flag is first checked at step #951. When the copy start flag has been set, or when the print switch has been turned on, state $1_H$ is set (step #952). Thus, from the next time, the operation will be started from state $1_H$. Thereafter, the operation flag is set (step #953), the carry flag used for a determination step is set (step #954), and then the operation returns to the original flow.

Further, when the copy start flag has not been set at step #951, whether the apparatus is being warmed up or not is checked (step #955). When the apparatus is being warmed up, copying operation is not allowed so as to protect fixing device 34, and the operation immediately returns to the original flow. On the other hand, when the apparatus is not being warmed up, it is checked whether a developer set request has been made or not, or whether the developer set flag has been set to request a developer setting operation or not (step #956). If it has not been requested, a carry flag is cleared (step #957) and the operation returns to the original flow. When it has been requested, the state is set to $30_H$ (step #958) so as to execute the developer set mode which begins with the previously described state $30_H$, and then the operation proceeds to step (#953).

Figure 16:
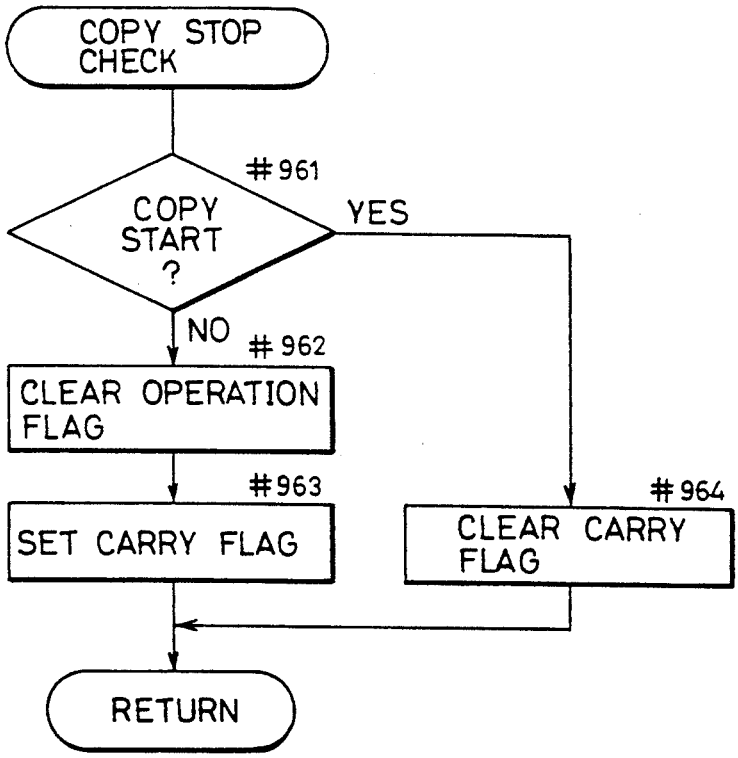
FIG. 16 is a flow chart diagram showing specific contents of the copy stop check routine in FIG. 14C.

Next, the copy stop check subroutine shown in FIG. 16 will be described. First, at step #961, determination is made as to whether a copy start flag has been set or not. When this flag has not been set, in order to stop copying, the operation flag is cleared (step #962), the carry flag is set (step #963) and then the operation returns to the original routine. On the other hand, when the copy start flag has been set, to continue copying operation, the carry flag is cleared and the operation returns to the original routine. Meanwhile, the carry flag here is used to determine whether copying is to be continued or stopped in the original routine.

Figure 17A:
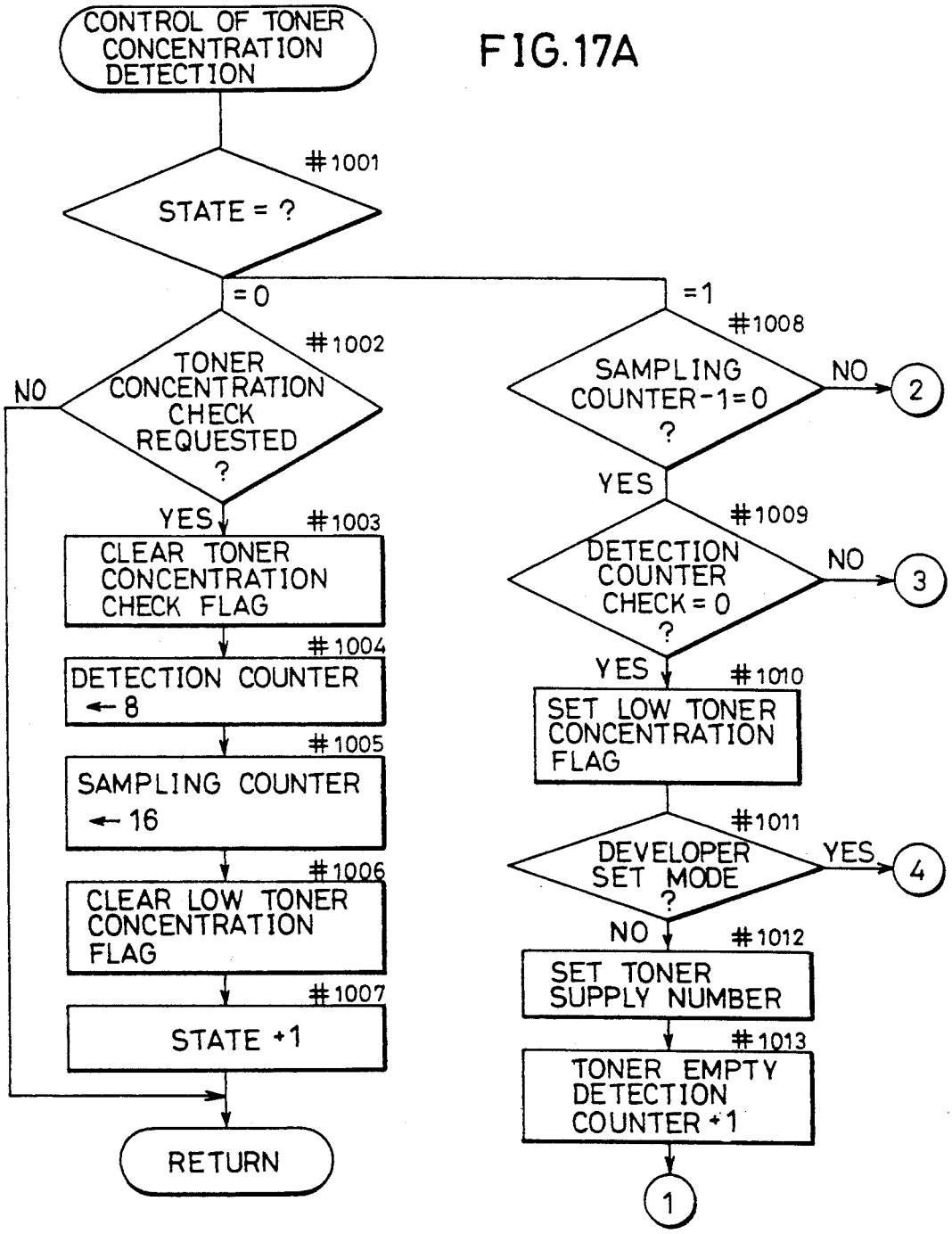
FIGS. 17A and 17B are flow chart diagrams showing specific contents of the routine for controlling detection of toner concentration shown in FIG. 8.
Figure 17B:
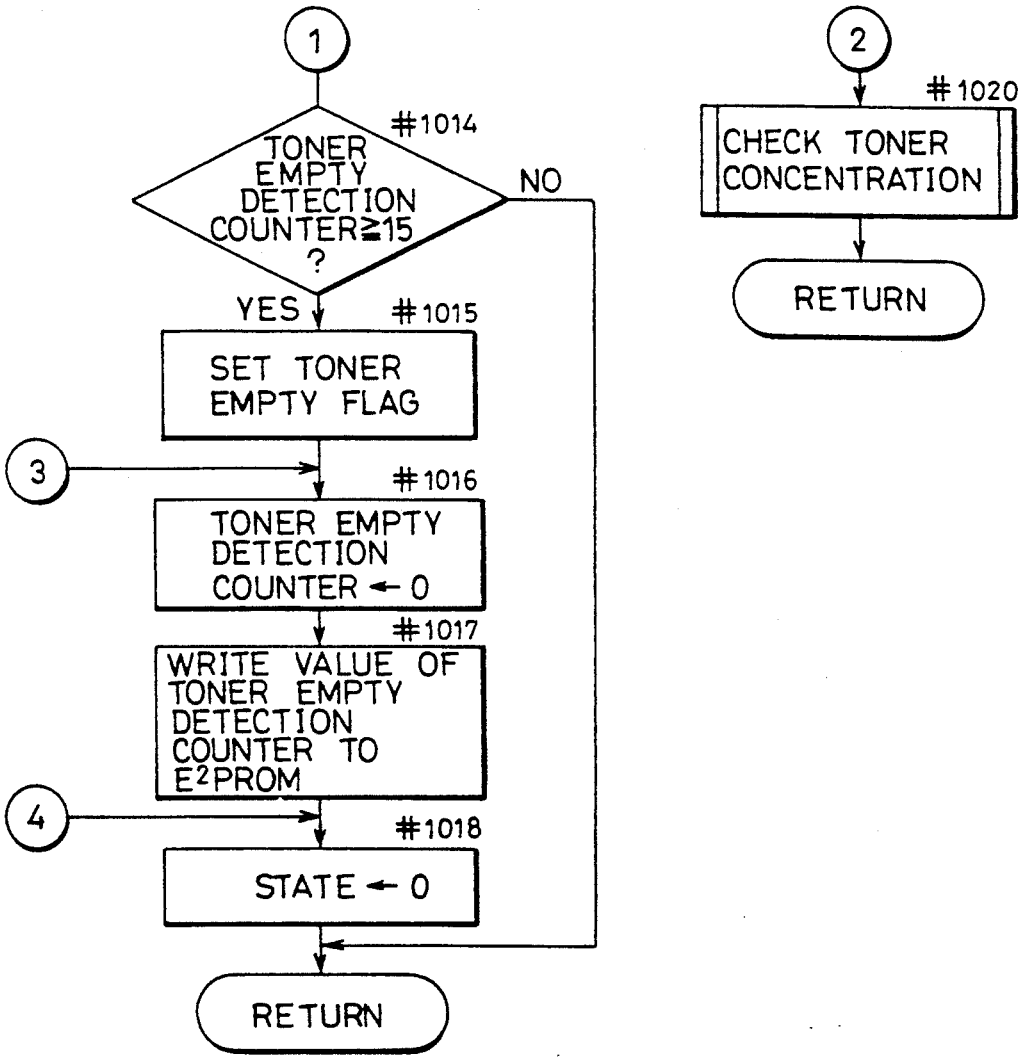

Further, the subroutine for controlling detection of toner concentration at step #10 in the main routine will be described. FIGS. 17A and 17B are flow chart diagrams of this subroutine. In the normal copying operation, toner concentration in the developing unit is detected to control the toner concentration such that it is held at a certain level. The control is conducted in two states of 0 and 1. In state 0, preparation is made for the detection and in state 1, an actual detecting operation is performed.

First, at step #1001, either of the two states is selected. In the case of state 0, whether check of toner concentration has been requested or not is detected based on set or reset of a toner concentration check flag (step #1002). If the request has not been made, the operation immediately returns to the main routine. If the request has been made, the toner concentration check flag is cleared at step #1003. Subsequently, the value of the detection counter is set to 8 at step #1004, and the value of the sampling counter is set to 16 at step #1005. The detection counter subtracts every time a low toner concentration is detected in the subsequent state 1. When the counter value eventually shows 0, it is synthetically determined that the toner concentration is low. The sampling counter shows how many times the level of toner concentration is determined, and subtracts every time one level is determined. When the value of the sampling counter reaches 0, or when the toner concentration has been detected 16 times, it is determined whether the toner concentration is low or not based on whether the value of the detection counter has reached 0 or not, or whether low toner concentrations have been determined more than 8 times. After these counters have been set, the low toner concentration flag is cleared (step #1006) and then the state is incremented by one (step #1007) to proceed to the following state.

In state 1, the sampling counter is first decremented by one to determine whether the result is 0 or not (step #1008). When the value of the sampling counter is not 0, namely when detection has not been done 16 times, the operation proceeds to the toner concentration check subroutine at step #1020. When the value of the sampling counter is 0, namely when the toner concentration has been detected 16 times, it is checked whether the value of the detection counter is 0 or not, namely whether the toner concentration is low or not (step #1009). When the value of the detection counter is 0, namely when the toner concentration is low, the low toner concentration flag is set (step #1010). Further, when the detection counter value is not 0, namely when the toner concentration is high, the operation proceeds to step #1016 to set the value of the toner empty detection counter to 0, the count value is written in $E^2$PROM 203 (step #1017) and then the state is returned to 0 (step #1018).

On the other hand, when the low toner concentration flag is set at #1010, it is determined based on the flag whether the developer set mode has been set or not (step #1011). When the developer set mode has not been set, the toner supply number is set and makes a toner empty detection counter count (step #1013). The toner empty detection counter detects whether toner has been emptied or not. The determination that toner has been emptied is made when copying has been made 15 times continuously with a toner concentration lower than 6%. Subsequently, it is determined at step #1014 whether the count value of the toner empty detection counter is larger than 15 or not. When the count value is larger than 15, it is determined that toner has been emptied, and the toner empty flag is set (step #1015), the above-described steps #1016 to #1017 are executed, the state is set to 0, and then the operation returns to the main routine.

On the other hand, when the developer set mode has been set at step #1011, the operation proceeds to step #1018. When the count value of the toner empty detection counter is smaller than 15 at steps #1014, the operation immediately returns to the main routine without performing any other processings.

Figure 18:
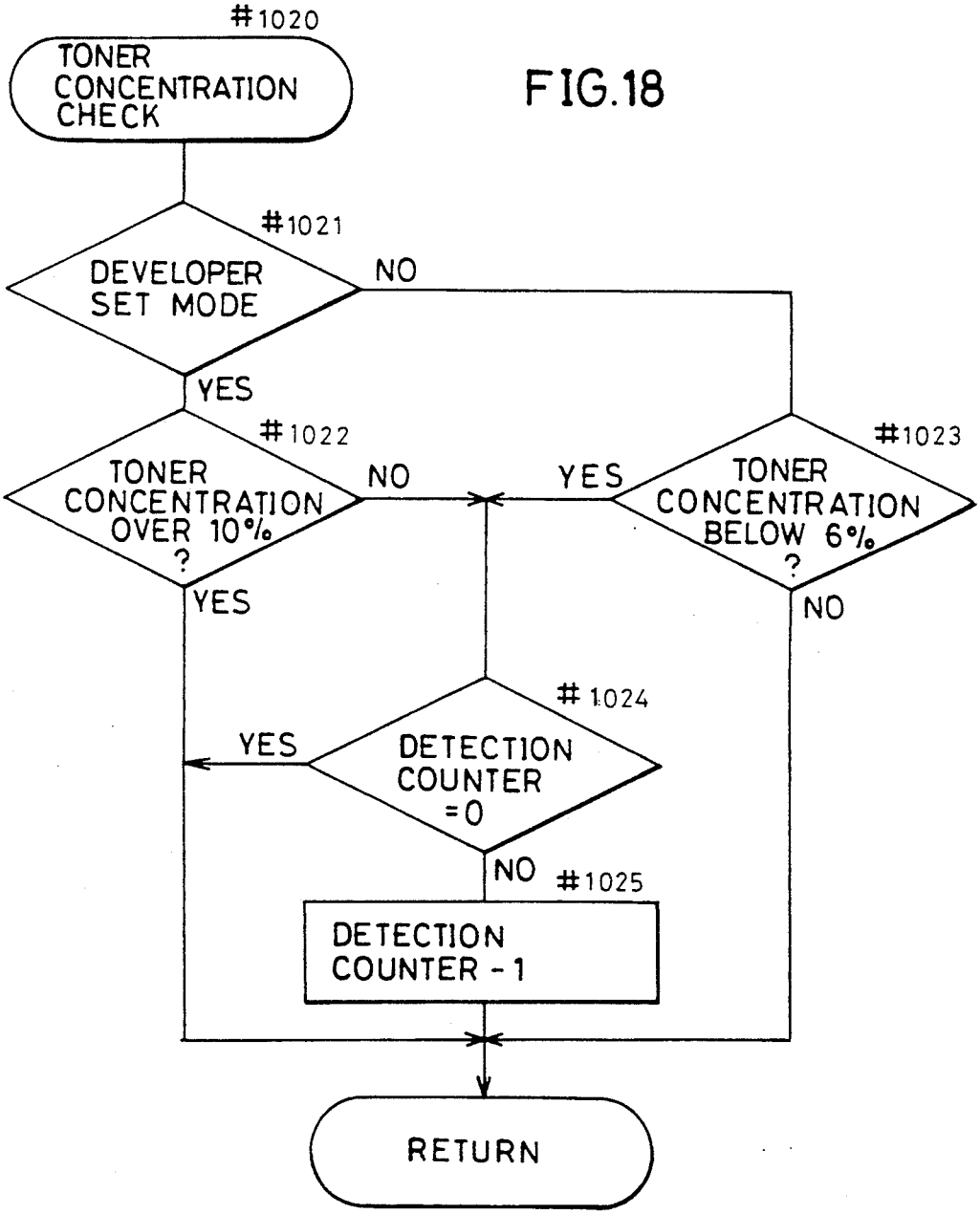
FIG. 18 is a flow chart diagram showing specific contents of the toner concentration check routine in FIG. 17B.

Subsequently, the toner concentration check subroutine shown in FIG. 18 will be described. In this subroutine, it is checked whether an output voltage from toner concentration sensor 13 is higher than a predetermined threshold value or not. Since the threshold value changes between the developer set mode and the normal copying operation, however, determination is first made as to whether the developer set mode has been set or not (#1021). In the developer set mode, it is determined from a detection voltage whether the toner concentration is over 10% or not, at step #1022. The toner concentration sensor 13 outputs a lower voltage as the toner concentration increases. Therefore, when the detection voltage is lower than a first predetermined value, it is determined that the toner concentration is over 10%. When the toner concentration is over 10%, processings of this routine are ended. On the other hand, when not in the developer set mode, or in the normal copying, made it is determined whether the toner concentration is lower than 6% or not (step #1023). When the toner concentration is higher than 6%, or when the detection voltage is lower than a second threshold value, processings of this routine are ended without proceeding to any further step. When the toner concentration is lower than 10% at step #1022 or when it is lower than 6% at step #1023, it is determined that the toner concentration is low and value of the detection counter is checked (step #1024). When the detection counter shows 0, toner concentrations have been detected 8 times already. Therefore, the operation immediately returns to the original toner concentration detection subroutine. When the detection counter does not show 0, the value of the detection counter is decremented by one (step #1025) and then the operation returns to the original flow.

In the present embodiment, a display at the operation panel shows 0 in the developer set mode to indicate that developer is being set. Thus, users can be informed of the state of the copying machine so as not to mistake the operation state.

Further, since in the present embodiment, it can be detected from detection voltages of the toner concentration sensor whether developer has been properly set or not, copying can be inhibited when developer has not been properly set. Therefore, when the starter has not been properly set, blank papers are not discharged in copying, preventing miscopying and also allowing setting of developer again.

Meanwhile, in the present embodiment, the detection of presence or absence of developer in the developing means is made based on determinations on the contents of data written at a specific address of $E^2$PROM in the image forming unit, or on whether the image forming unit has been already used or not yet. However, the present invention is not limited only to this embodiment, but the detection of presence or absence of developer may be made by a detector directly provided in the developing unit.

Further, in the present embodiment, whether the image forming unit has been used or not is determined by determining the contents of data written at a specific address of $E^2$PROM. However, the present invention is not limited only to this embodiment, but it may be determined by using a switch provided in the image forming unit.

Furthermore, in the present embodiment, developer is supplied to the developing unit in 151 steps. However, the present invention is not limited to only this embodiment, but the operation may be continued until the container has been emptied or only a certain amount may be supplied using a timer and the like.

Furthermore, while in the embodiment, a developer of two component system composed of toner and magnetic carrier is used, another developer of mono component system is also applicable to the present invention.

As has been described above, according to the present invention, presence or absence of developer in the developing means is detected based on a determination as to whether the developing means has been used or not, and control is performed such that a certain amount of developer is supplied by developer supply means when there is no developer in the developing means. Therefore, in setting up the apparatus, no service man is necessary to load developer and instead, users can easily load developer. Accordingly, desirable effects such as a reduction in price can be obtained.

Meanwhile, as shown in the above-mentioned embodiment, when a user mounts a starter container on the toner supply unit in the starter loading mode, a toner container may be inadvertently mounted instead of the starter container. Thus, when toner is loaded in the developing unit in the mode for loading starter by a predetermined operation, the toner is not transported to the photoreceptor since it does not comprise any carrier. Therefore, when the copying operation is continued in such a state, an electrostatic image on the photoreceptor cannot be developed. In this case, therefore, it is necessary to detach the developing unit so as to remove all the toner therein, and to load starter again.

In addition, such a copying machine has a starter loading mode for loading starter in setting up the machine. Therefore, a starter container is mounted on the toner supply unit instead of the toner container and the developing unit is first filled with starter in the starter loading mode. Thereafter, the toner container is mounted. If starter is again loaded in a developing unit which has already loaded starter, the toner concentration is reduced due to an increased amount of carrier since starter comprises carrier only or both carrier and toner. To prevent this situation, it is necessary to inhibit twice loading of starter.

In the meantime, in case where some foreign matter has mixed in developer or carrier used in the developing unit has spoiled, replacing the spoiled carrier with a new one is required.

In order to solve the problems as described above, an image forming apparatus according to the following embodiment will be described.

Meanwhile, since FIGS. 1, 2, 3, 4, 6, 7, 10, 11, 14A, 14B, 14C, 14D, 14E, 15, 16 and 18 of the previously described embodiment are also available for the present embodiment and both embodiments have common contents, additional drawings are not attached and also the description is not repeated. Therefore, in the following description, only those points different from the previous embodiment will be described.

Figure 19:
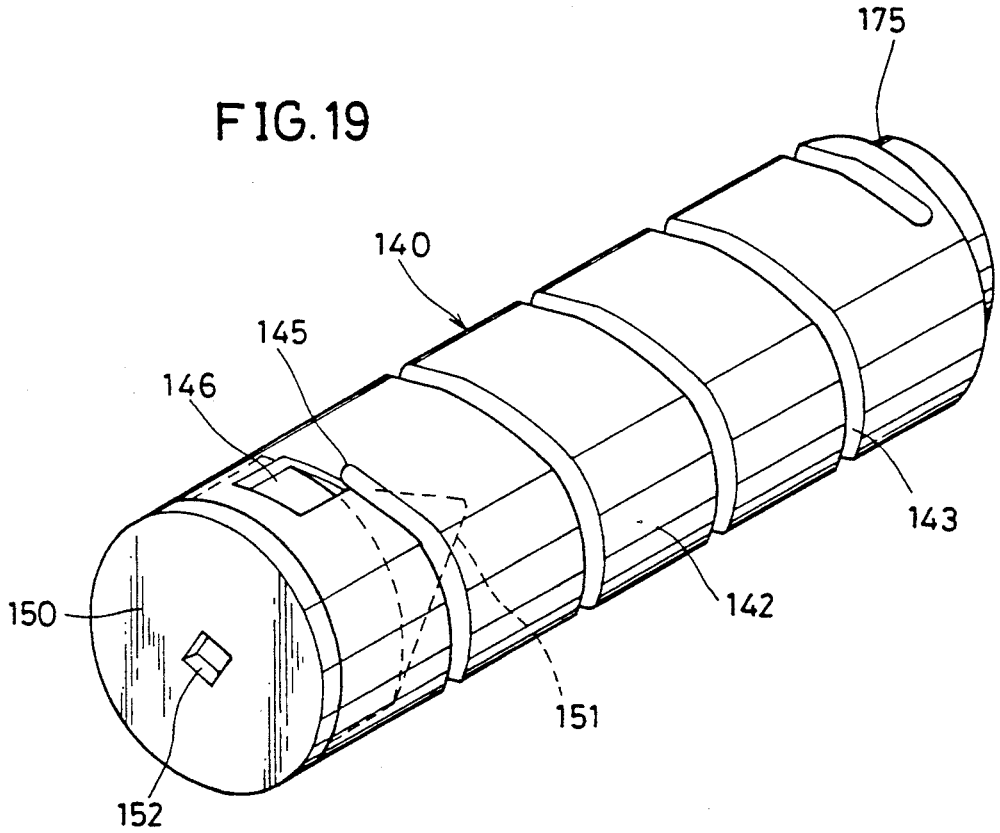
FIG. 19 is a schematic perspective view showing structure of a toner supply unit according to another embodiment of the present invention.
Figure 20:
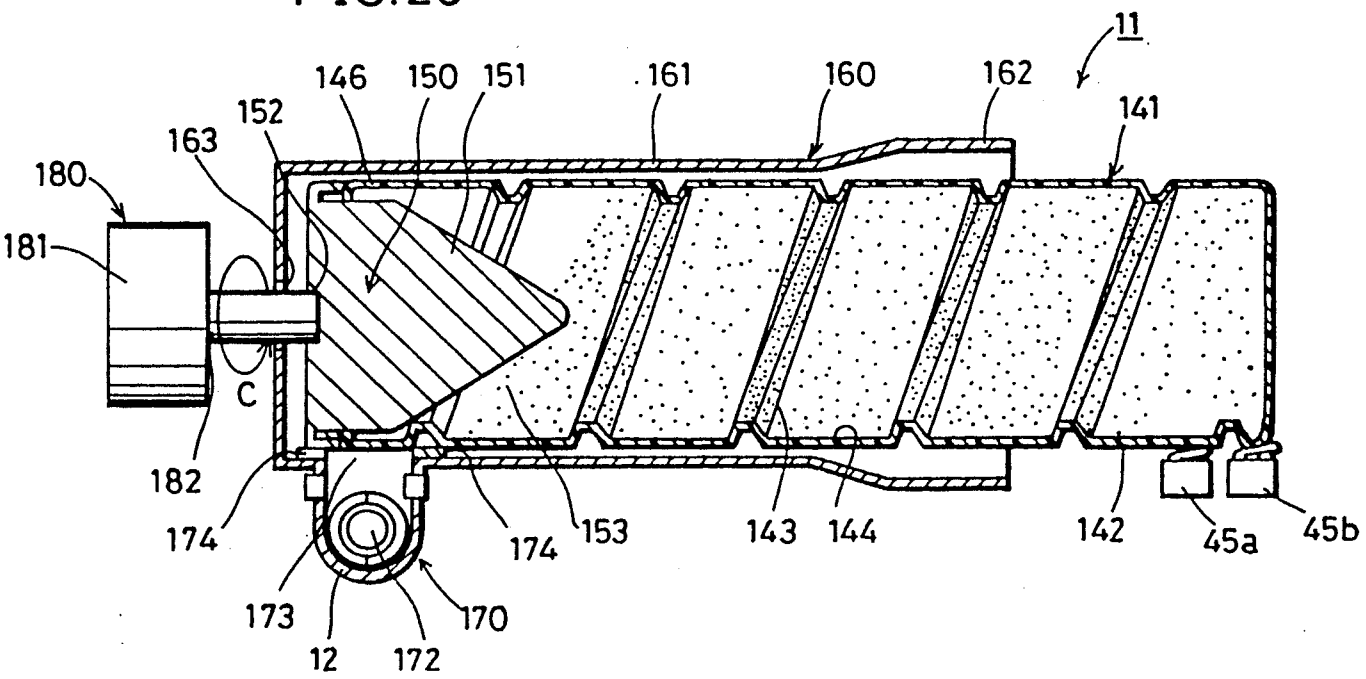
FIG. 20 is a sectional view showing structure of a developer supply unit according to another embodiment of the present invention.
Figure 21:
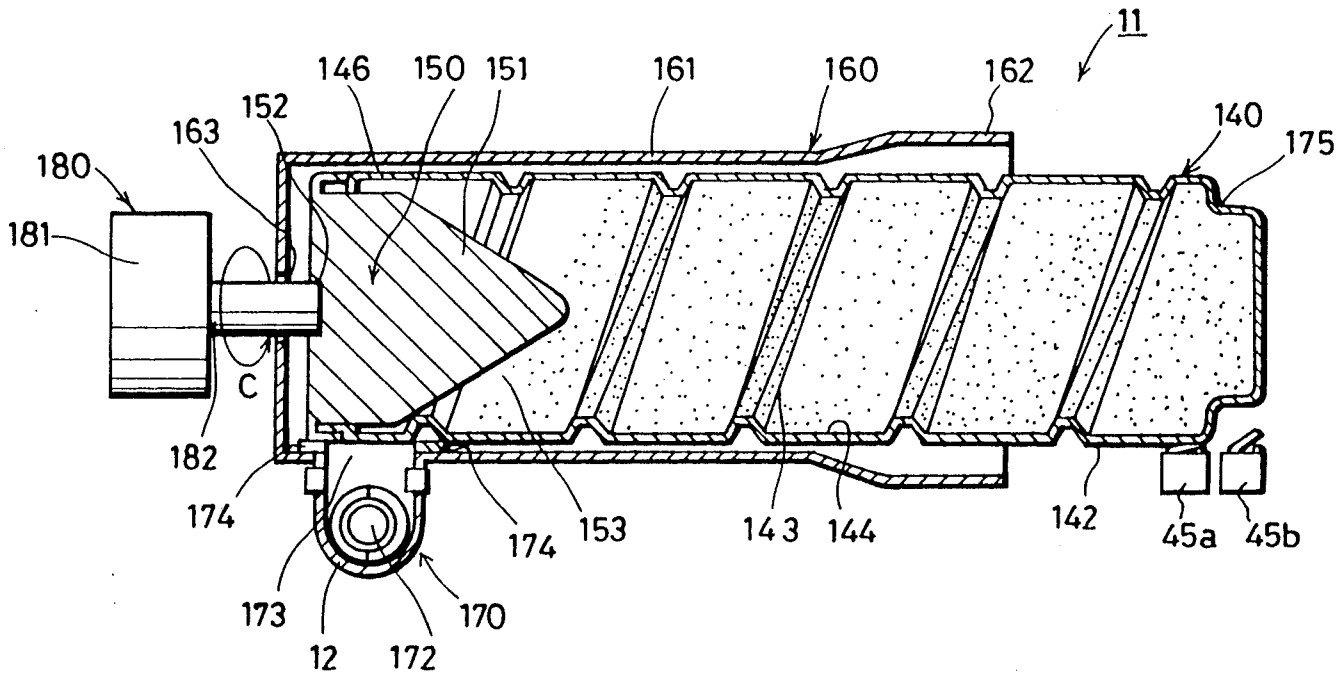
FIG. 21 is a sectional view showing structure of a toner supply unit according to another embodiment of the present invention.

FIG. 19 is a perspective view showing structure of a developer supply unit (referred to as "starter container" hereinafter) and FIG. 20 is a longitudinal sectional view showing a toner container and FIG. 21 is a longitudinal sectional view showing structures of the respective components of a developer supply unit.

Starter container 140 has in general the same configuration as that of toner container 141 as shown in FIG. 19 and only one different point is that stepped diameter reducing portion 175 is provided at the closed end of cylinder 142.

The structure and operation of the toner container and the starter container in the present embodiment are basically the same as those in the previous embodiment except the following points.

Container detection sensors 45*a* and 45*b* having limit switches are provided closely to each other under the closed end of cylinder 142. When toner container 141 shown in FIG. 20 is mounted, both container detection sensors 45*a* and 45*b* are turned on, while when starter container 140 shown in FIG. 21 is mounted, only sensor 45*a* is turned on and sensor 45*b* is in the off-state. Further, when neither of the containers has been mounted, both sensors 45*a* and 45*b* are in the off-state. Thus, the mounted state and types of the containers are determined.

Figure 22A:
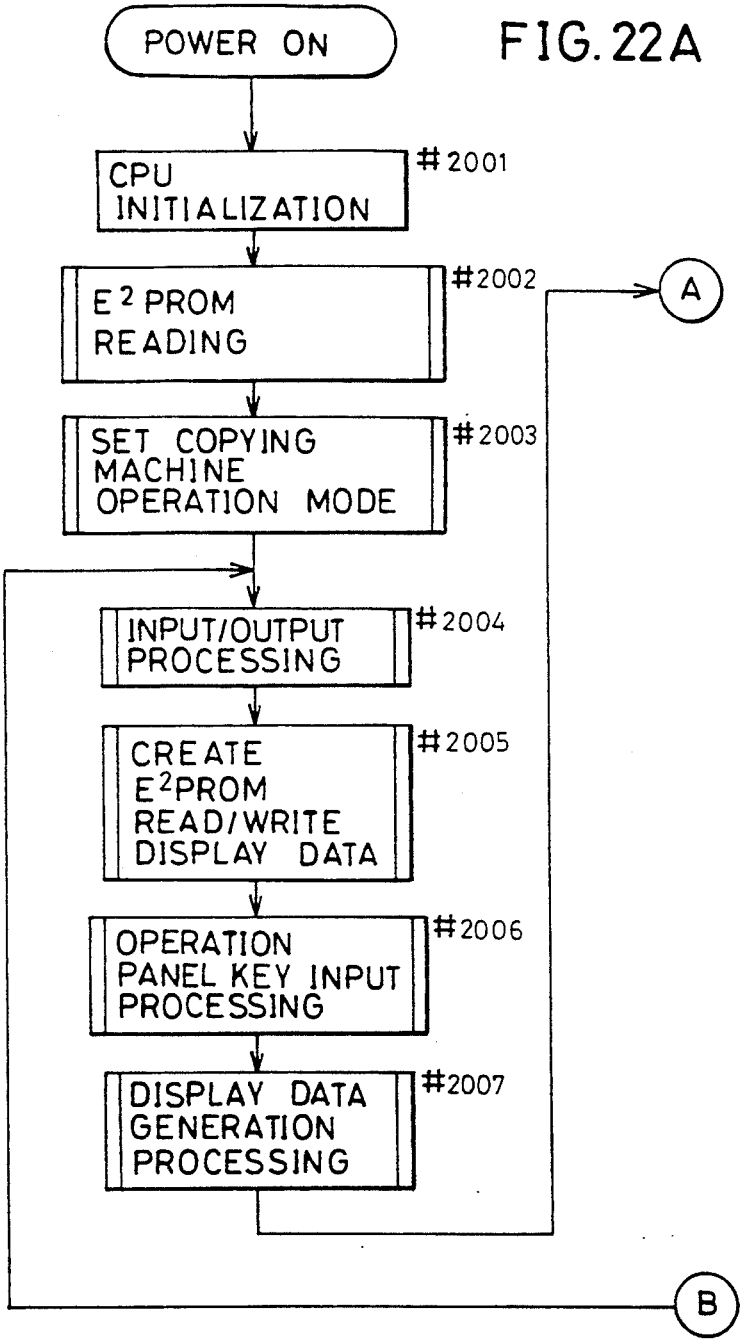
FIGS. 22A and 22B are flow chart diagrams showing contents of the main routine executed by CPU in another embodiment of the present invention.
Figure 22B:
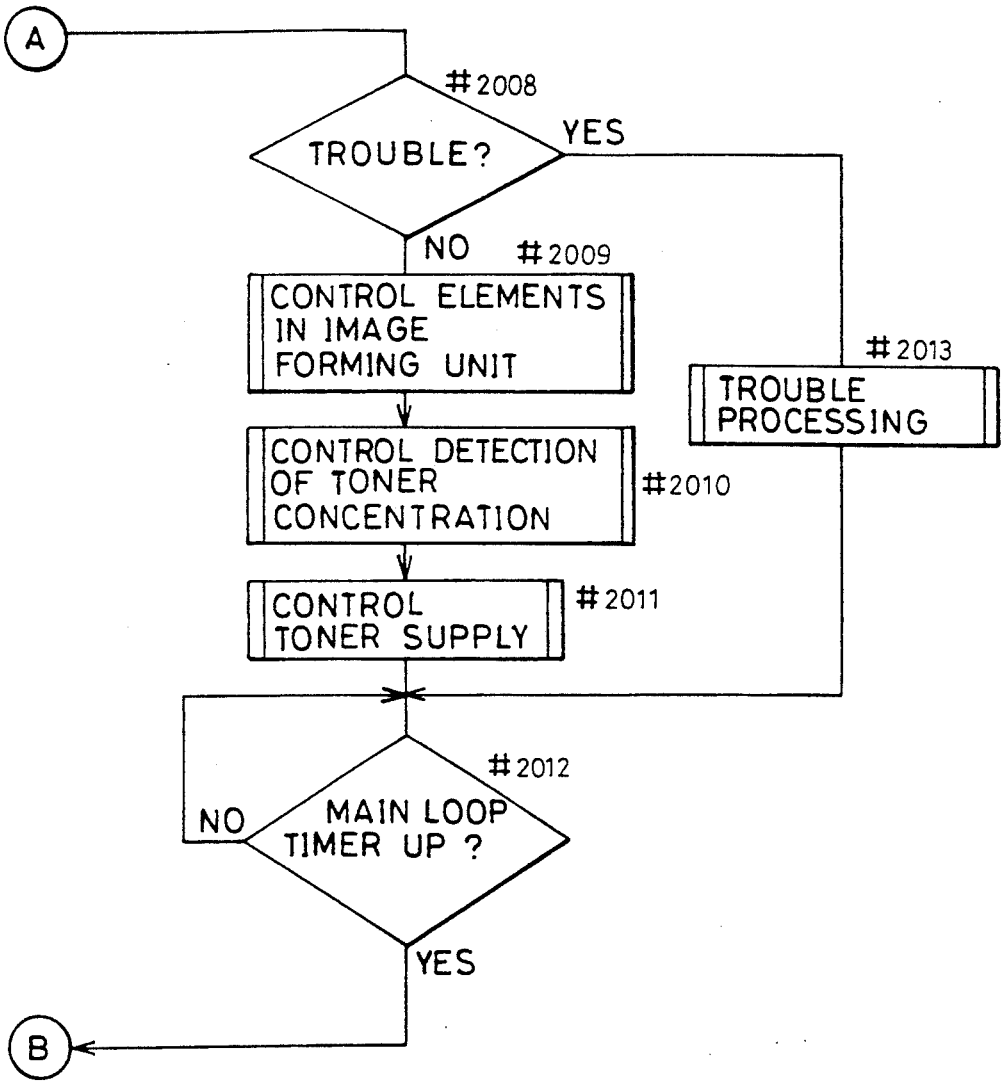

FIGS. 22A and 22B are flow chart diagrams showing the main flow of the apparatus according to the present embodiment, which correspond to FIG. 8 of the previous embodiment.

Since most of the flow chart is the same as that of the previous embodiment, only the different points will be described below.

First, whether any trouble such as jamming in body 1 of the copying machine, abnormal temperatures of fixing device 34 and the like has taken place or not is checked (step #2008). When any trouble has arisen, reason, trouble processings such as display of the trouble, stop of the copying machine and the like are performed at step #2013, without performing the following control.

Figure 23A:
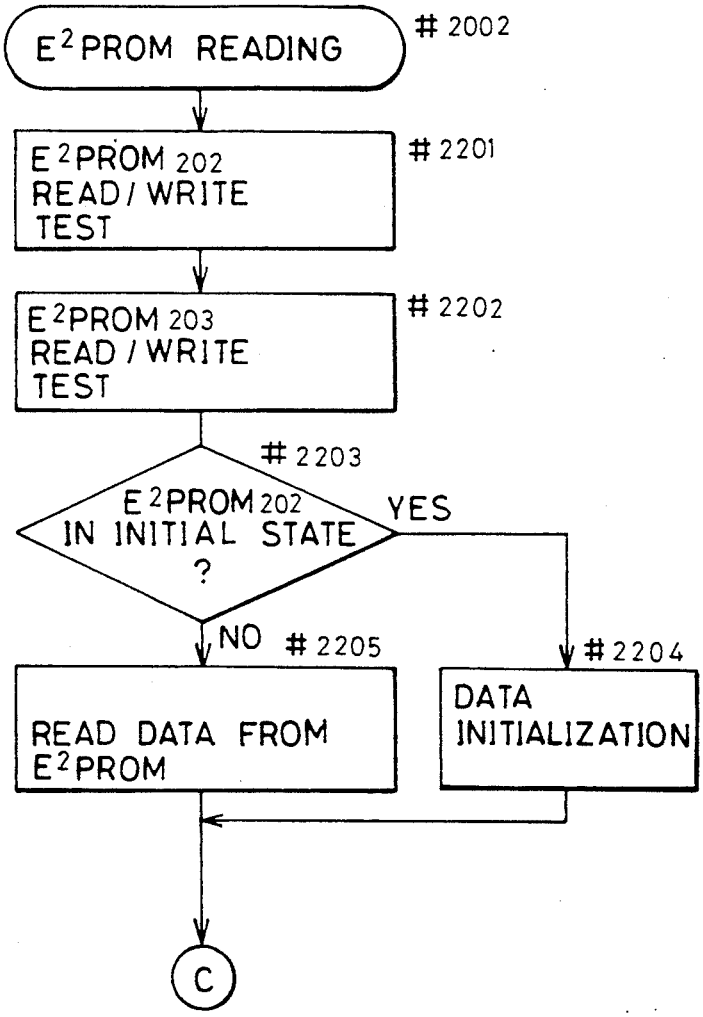
FIGS. 23A and 23B are flow chart diagrams showing specific contents of the $E^2$PROM reading routine in FIG. 22A.
Figure 23B:
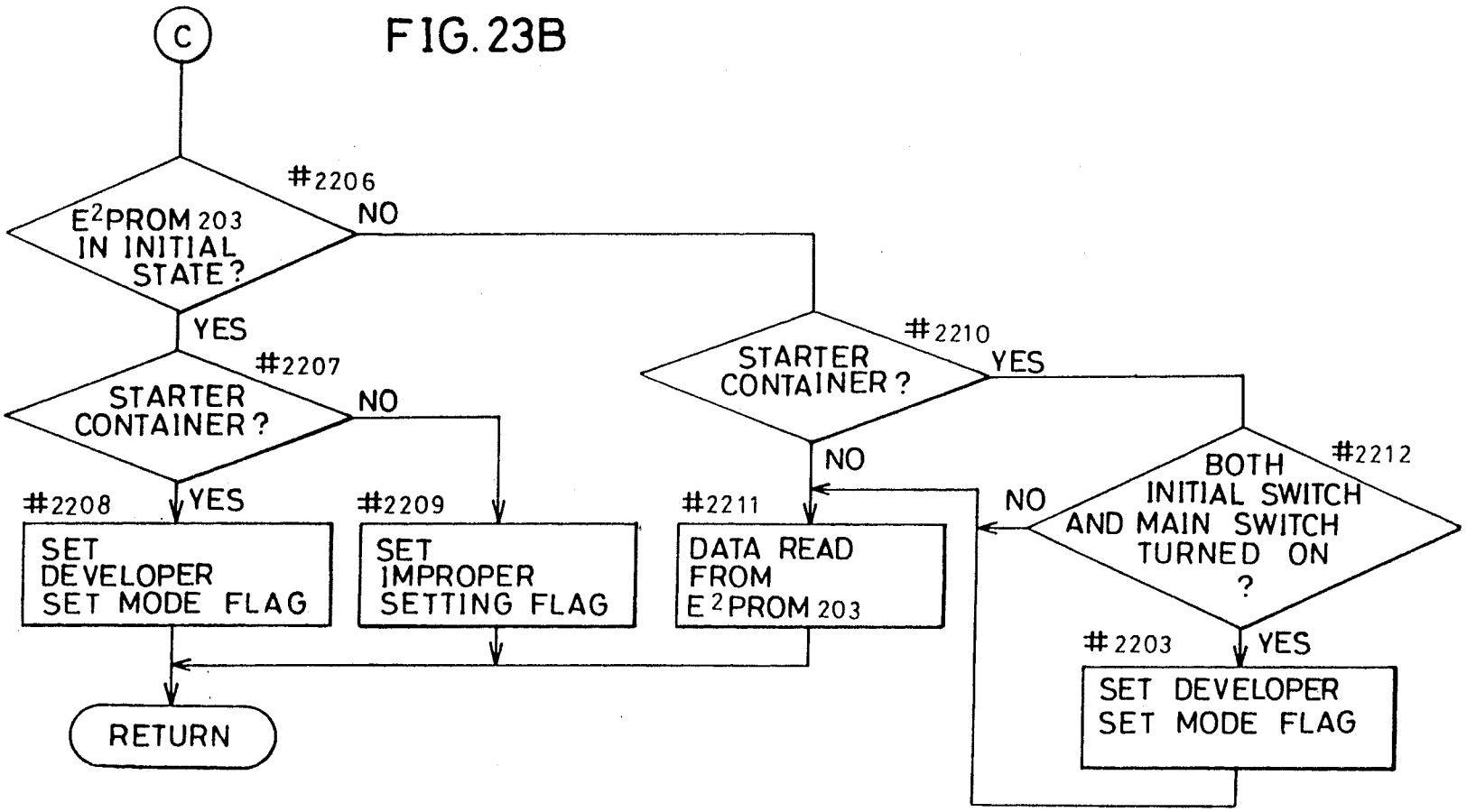

FIGS. 23A and 23B are flow chart diagrams showing procedure of the $E^2$PROM initialization subroutine at step #2002 in this embodiment. First, read and write test is performed for a predetermined address of $E^2$-PROM 202 in body 1 (step #2201). Subsequently, read and write test is performed for a specific address of $E^2$PROM 203 in image forming unit 40 (step #2202). In these tests, an abnormal connection of $E^2$PROMs 202 and 203 is detected. Then, data at a second address different from the above-mentioned address in $E^2$-PROM 202 is read out to check the initial state of $E^2$-PROM 202, based on the contents of the data step #2103). When $E^2$PROM 202 is in the initial state, initial data is written in at the second address at step #2204. When $E^2$PROM 202 is not in the initial state, data of various modes and flags stored in $E^2$PROM 202 are read out and written in RAM 204 (step #2105). Subsequently, in the same manner as at step #2203, the initial state of $E^2$PROM 203 in image forming unit 40 is checked (step #2206). When $E^2$PROM 203 is in the initial state, whether starter container 140 has been set or not is checked by means of container detection sensors 45*a* and 45*b* (step #2207). When this container has been set, namely when container detection sensor 45*a* is in the on-state and the sensor 45*b* is in the off-state, the developer set mode flag is set (step #2208) and the operation returns to the main routine. When the starter container has not been set and both container detection sensors 45*a* and 45*b* are in the on-state, or when toner container 141 has been set and both container detection sensors 45*a* and 45*b* are in the off-state, an improper setting flag is set (step #2209) and the operation returns to the main routine. That is, it is detected based on patterns of $E^2$PROM that image forming unit has not been used yet. If starter container 140 has been set when image forming unit 40 has not been used, a flag is set to start the developer set mode. If the container has not been set, the improper setting flag is set so as not to allow supply of toner. When $E^2$PROM 203 is not in the initial state, whether starter container 140 has been set or not is checked (step #2210), like at step #207. When this container has not been set, information such as the life time of developing unit 4 and the toner empty flag stored in $E^2$PROM 203 is read out and written in RAM 204 (step #2211), and then the operation returns to the main routine. When this container has been set, whether main switch 122 and initial switch 123 are simultaneously turned on/off or not is checked at step #2212. When they have been turned on together, it is determined that the developer set mode has been requested due to some causes, and the developer set flag is set (step #2213). When neither of them have been turned on and thus, are in the off-state, the operation proceeds to step #2211.

In this manner, erroneous supply of toner in the developer set mode can be prevented.

Figure 24:
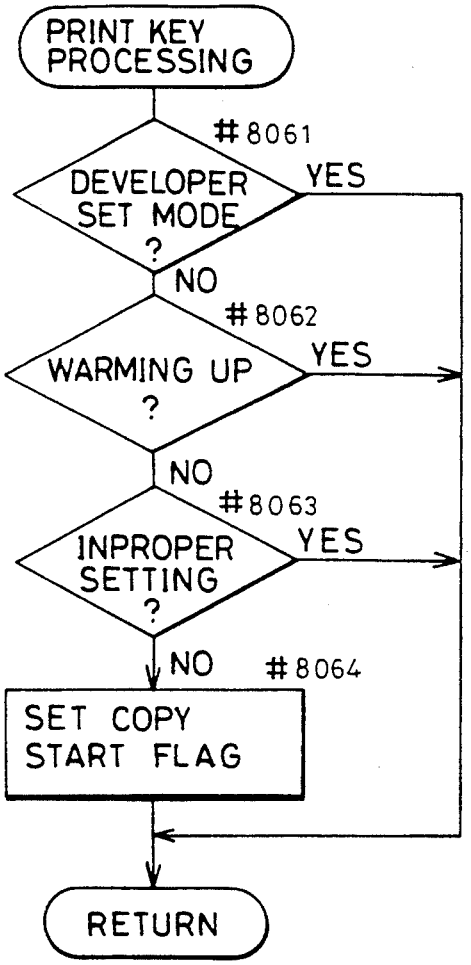
FIG. 24 is a flow chart diagram showing the print key processing according to another embodiment of the present invention, which is to be compared with the previous embodiment shown in FIG. 12.

FIG. 24 is a flow chart diagram showing the print key processing routine in this embodiment, which corresponds to FIG. 12 of the previous embodiment. In the following, only the different points will be described. The improper setting flag is checked at step #8063. When this flag has been set, or when any container other than starter container 140 has been set, copying is not allowed.

Figure 25:
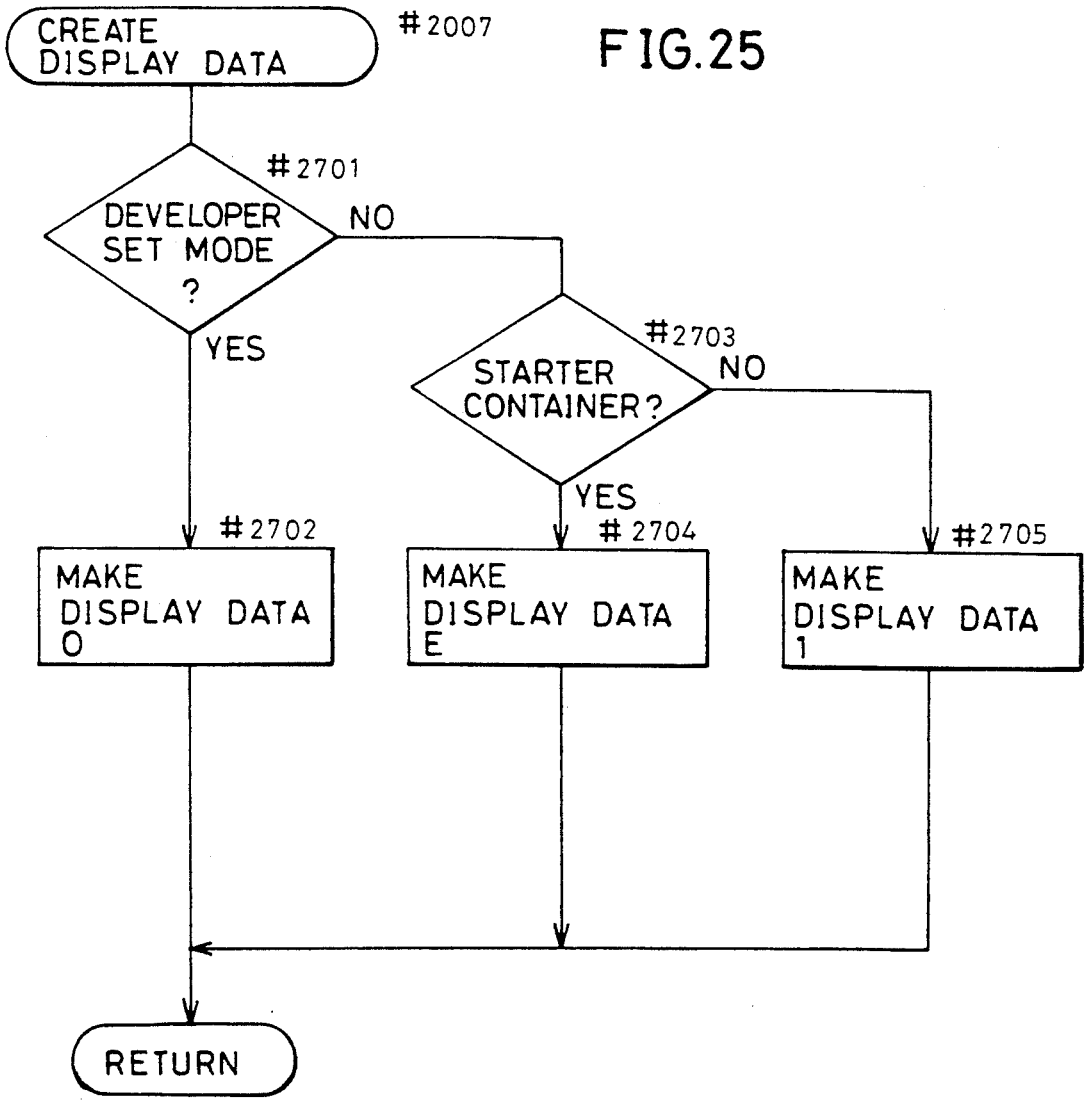
FIG. 25 is a flow chart diagram showing specific contents of the display data generating routine in FIG. 22A.

Subsequently, the display data generating subroutine will be described. FIG. 25 is a flow chart diagram showing this subroutine. First, whether the developer set mode flag has been set or not is determined at step #2701. When this flag has been set, display data shown by display 72 is set to "0". When this flag has not been set, it is determined at step #2703 whether starter container 140 has been set or not. When the starter container 140 has been set, the display data is made to represent "E" indicative of an error (step #2704). When starter container 140 has not been set, the display data is made to represent "1" (step #2705) and the operation returns to the main routine.

Figure 26:
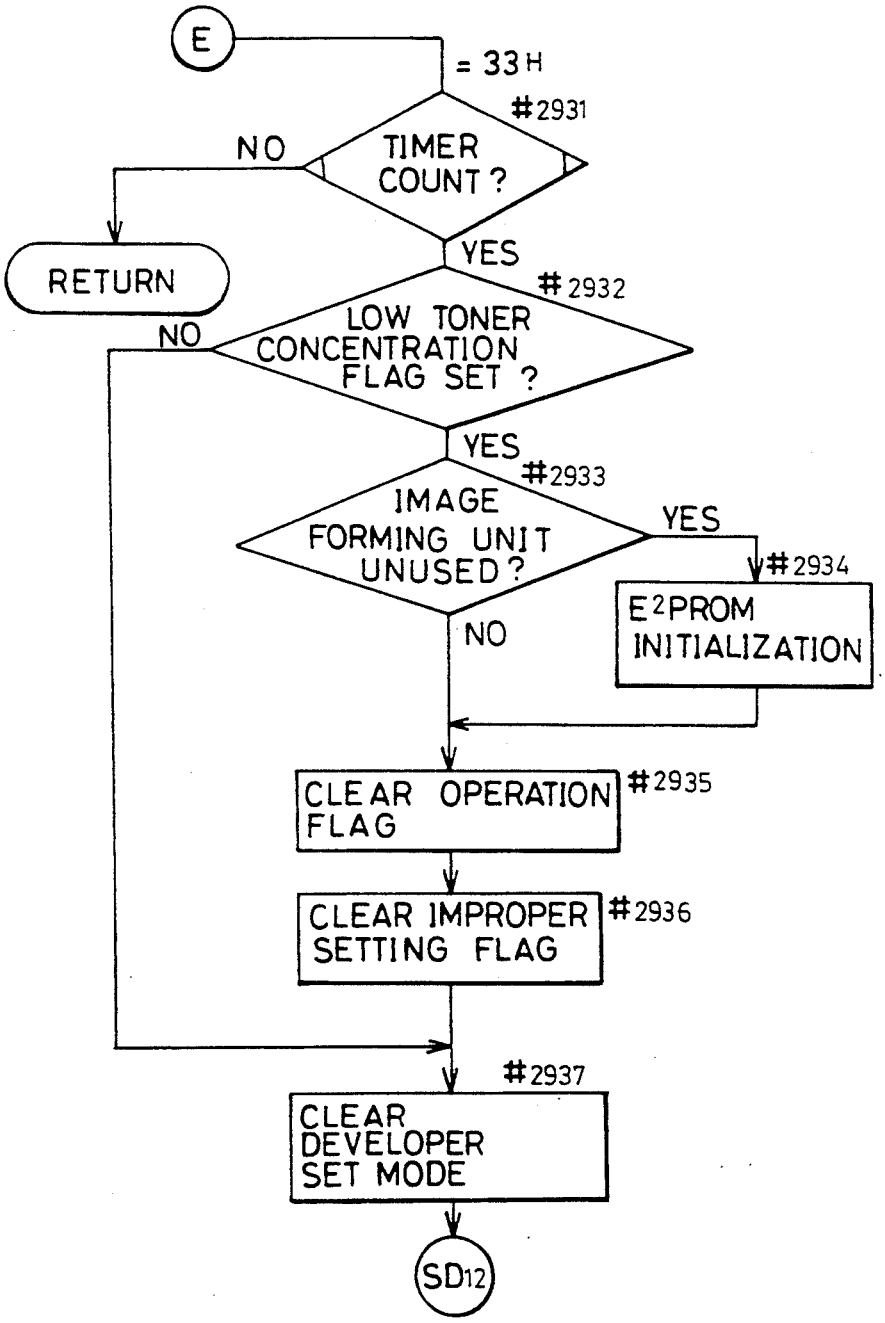
FIG. 26 is a flow chart diagram showing a control routine according to another embodiment of the present invention, which is to be compared with the previous embodiment shown in FIG. 14F.

FIG. 26 is a flow chart diagram showing the procedure of controlling the components in the image forming unit in the present embodiment, which corresponds to FIG. 14F of the previous embodiment. Only the different points therebetween will be described below.

The improper setting flag is cleared at step #2936, the developer set mode flag is further cleared (step #2937) so as not to allow operation of the developer set mode again, and then the operation proceeds to motor stop operation in state $C_H$.

Figure 27A:
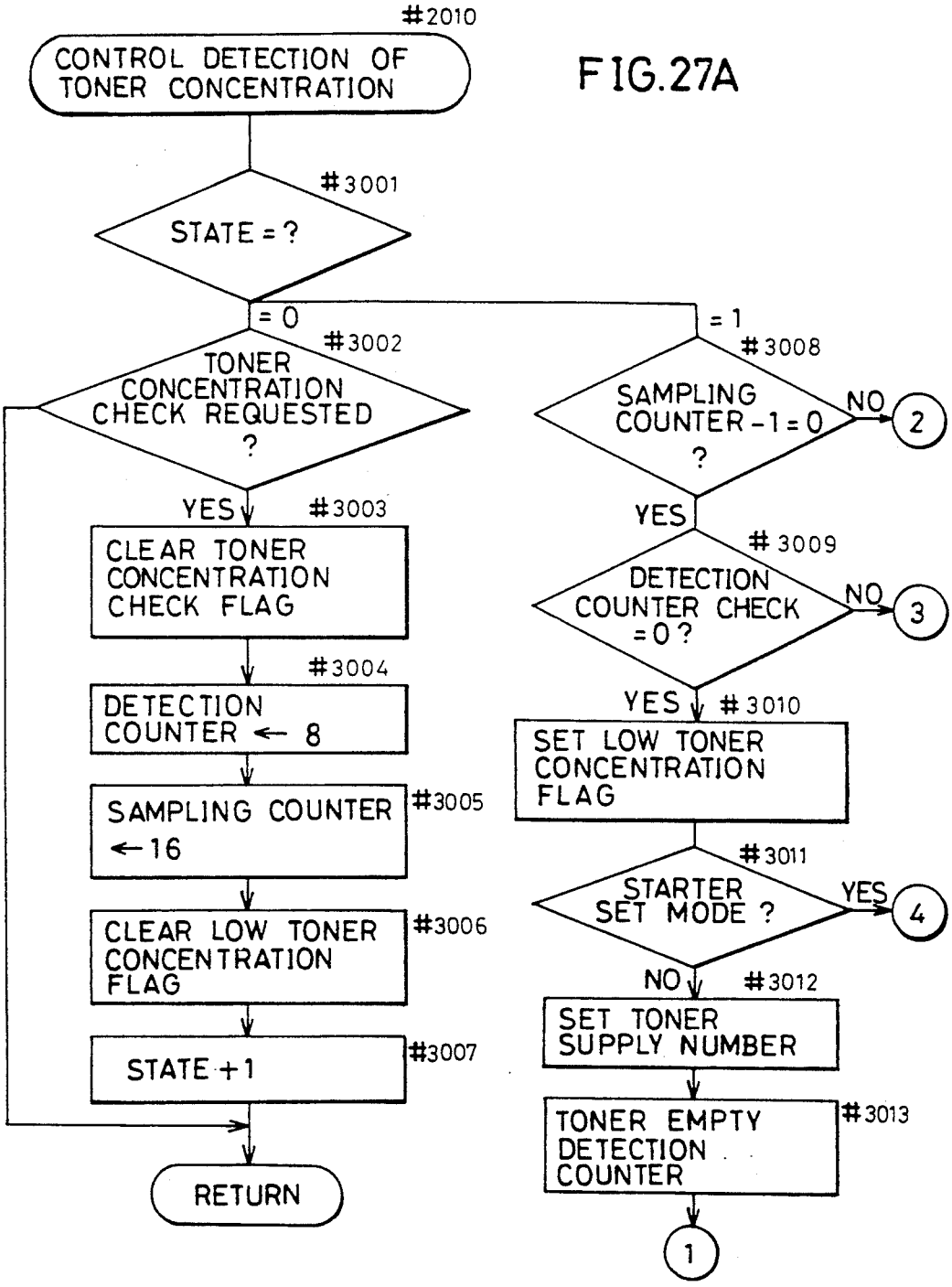
FIGS. 27A and 27B are flow chart diagrams showing specific contents of the routine for controlling detection of toner concentration shown in FIG. 22B.
Figure 27B:
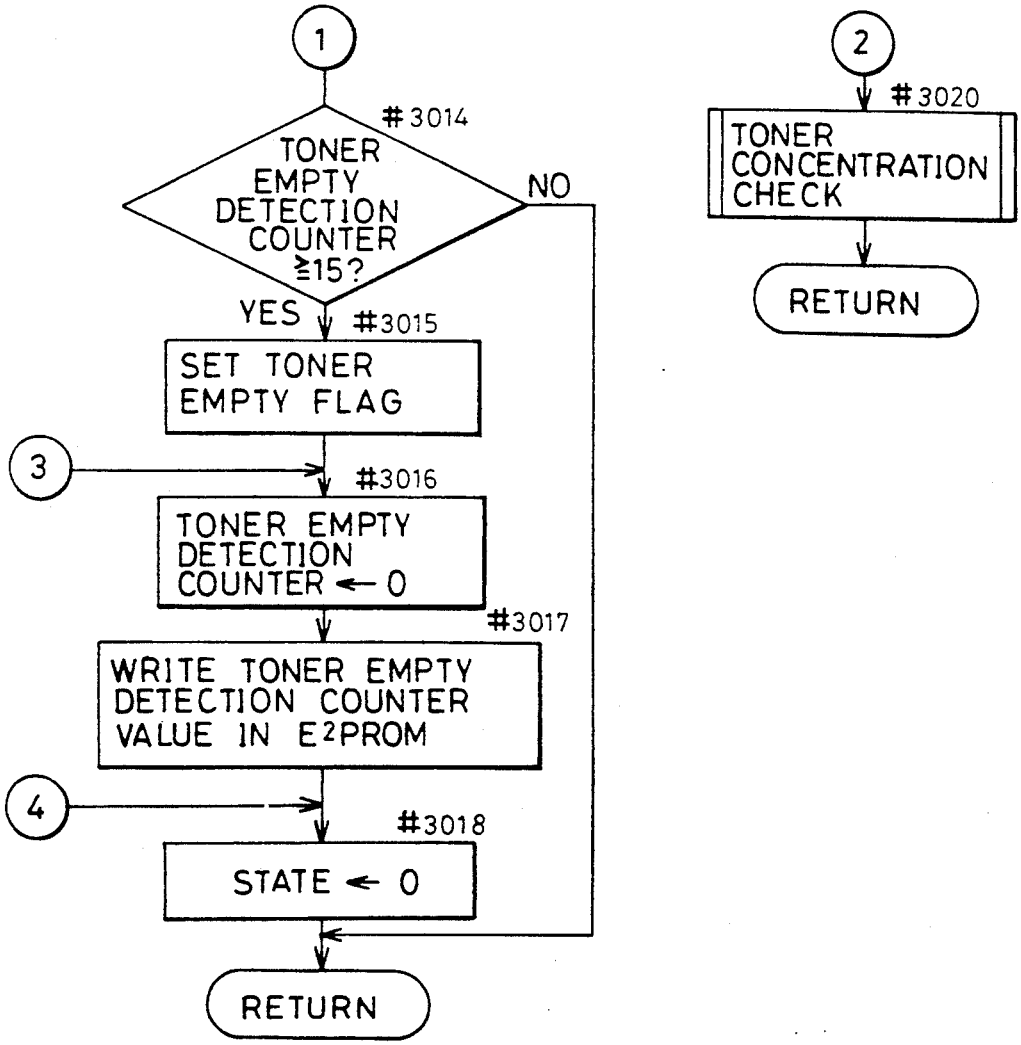

FIG. 27 is a flow chart diagram showing the routine for controlling detection of toner concentration in the present embodiment, which corresponds to FIG. 17A in the previous embodiment. Only the different points therebetween will be described below.

When a starter set mode has been set at step #3011, the operation proceeds to step #3018 to set the state to 0, and then the operation returns to the main routine.

Figure 28A:
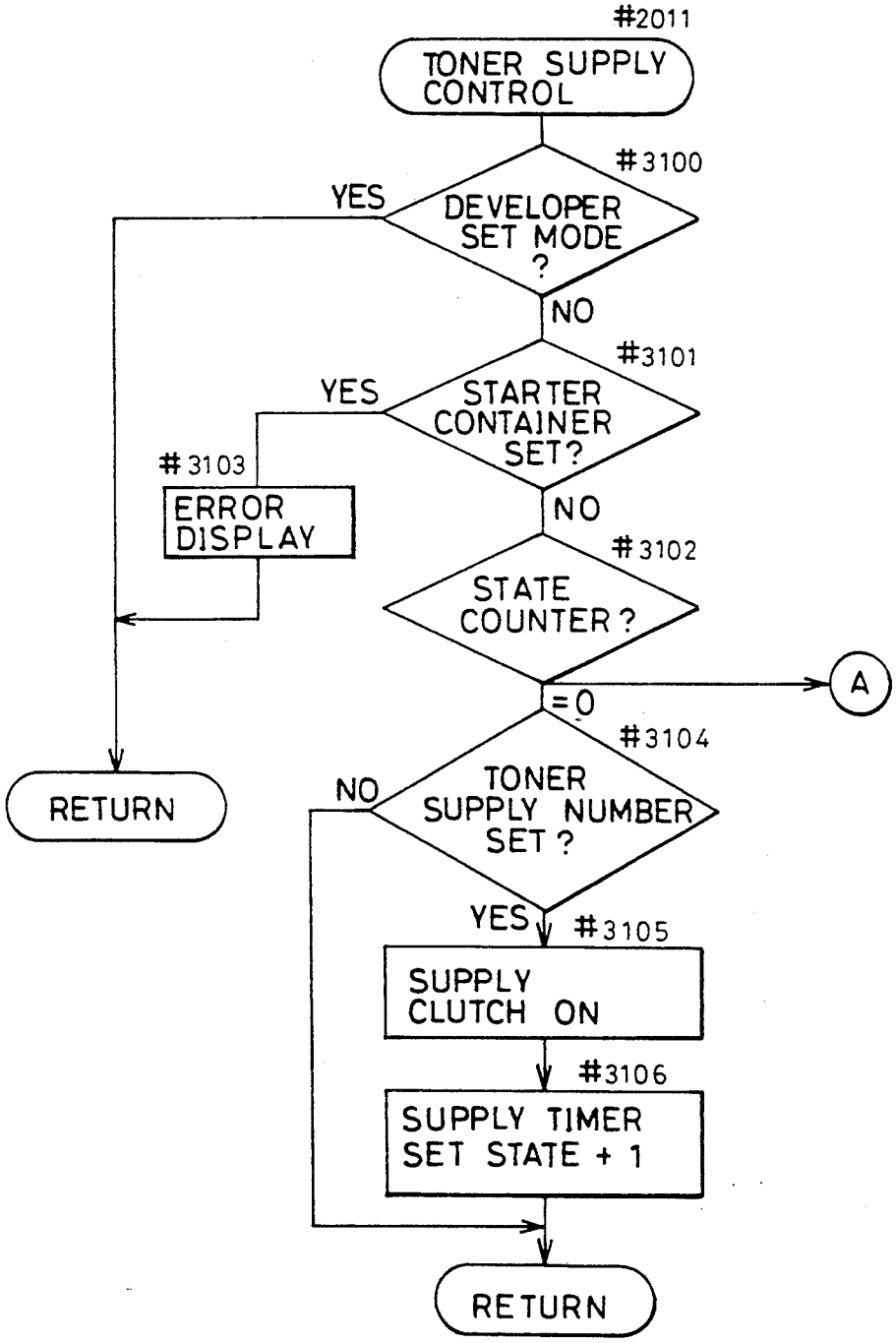
FIGS. 28A and 28B are flow chart diagrams showing specific contents of the toner supply control routine shown in FIG. 22B.
Figure 28B:
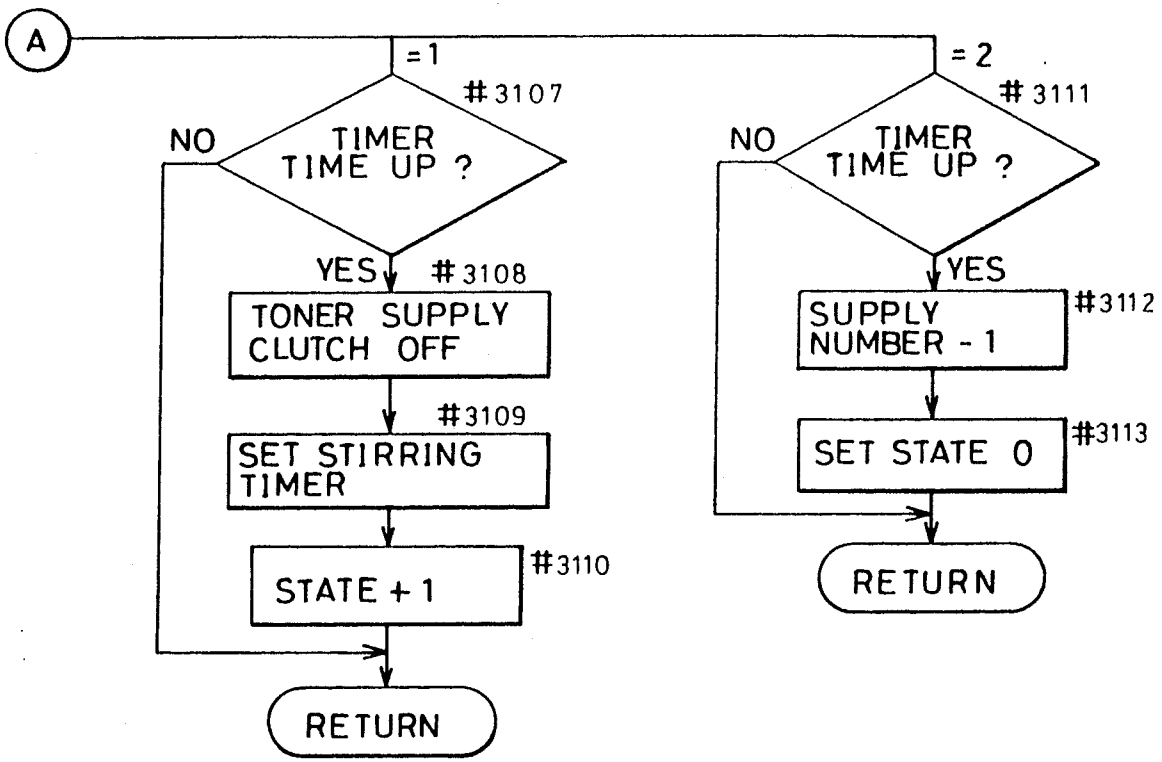

Subsequently, the toner supply control subroutine (step #2011) shown in FIGS. 28A and 28B will be described. In this subroutine, normal toner supply operation in the copying operation is controlled. When some conditions for toner supply are met, the toner supply operation and stirring operation of the supplied toner are repeated a predetermined number of times.

First, it is checked at step #3100 whether the developer set mode has been requested or not. When the developer set mode request flag has been set, the toner supply operation is not performed in this subroutine but the operation returns to the main routine. When this mode has not been set, it is checked at step #3101 whether starter container 140 has been set or not. When starter container 140 has been set, "E" indicative of an error is shown by display 72 (step #3103) and then the operation returns to the main routine. When toner container 141 has been set, the operation proceeds to the following step #3102 to perform normal toner supply, and check in which state the control is done. In state 0, it is checked at step #3104 whether the number of toner supply has been set or not. When this number has been set, the toner supplied clutch is turned on at step #3105. Thereafter, a supplied timer is set, the state is incremented by one (step #3106) and then the operation returns to the main routine. When the toner supply number has not been set, the operation immediately returns to the main routine without performing any other processing.

In state 1, no processing is done until a predetermined time has passed. After the predetermined time has passed (step #3107), the toner supply clutch is turned off (step #3108), a timer for stirring is set (step #3109), the step is incremented by one (step #3110) and then the operation returns to the main routine.

In state 2, no processing is made until a predetermined time has passed. After the predetermined time has passed (step #3111), the supply number is decremented by one (step #3112), the state is set to 0 (step #3113) and then the operation returns to the main routine.

Meanwhile, in the present embodiment, "0" is shown by a display at the operation panel in the developer set mode so as to indicate that developer is being set. If a toner container is inadvertently set at this time, "E" is displayed. Therefore, users can be informed of the state of the copying machine, so that erroneous operation by the users can be prevented.

Also, when it is detected in the toner set mode that a starter container has been set, "E" is displayed. In this case also, therefore, erroneous use of the machine can be prevented.

Further, according to the present embodiment, whether developer has been properly set or not can be detected from detection voltages of the toner concentration sensor. Therefore, copying can be inhibited when developer has not been properly set. Accordingly, blank papers cannot be discharged in copying even if starter has not been properly set, preventing miscopying and also allowing setting of developer again by use of the initial switch.

Meanwhile, while in the present embodiment, the detection of presence or absence of developer in the developing means is made by determining whether the image forming unit has been already used or not, based on patterns of $E^2$PROM, the present invention is not limited to only this embodiment, but presence or absence of developer may be detected directly by a detector provided in the developing unit. For example, the determination that the developing unit has not been used yet can be made by detecting presence or absence of developer (carrier), based on output of a magnetic sensor, which has been disclosed in the embodiment as a method of detecting completion of supply.

Further, while in the present embodiment, difference of the toner container and the starter container is detected based on difference in their configuration, the present invention is not limited only to the present embodiment, but some indicator such as mark and barcode may be attached to those containers to allow detection of the difference therebetween.

As has been described above, according to the present invention, difference of the developer container and the toner container is detected and if the toner container has been mounted to the supply means when supply of developer is required, the developer supply operation is inhibited. Therefore, even if a user has mounted an erroneous container, toner cannot be supplied, obviating any trouble which might be caused by the erroneous container in the apparatus.

Further, according to the present invention, even if the developer set mode is inhibited when the developing means has been already used, the inhibition of the developer set mode is canceled by simultaneously turning on the initial switch and the main switch in a predetermined manner to allow automatic supply of developer, if so required for some reason. Thus, the supply work by a professional service man can be eliminated, reducing the service cost and also prices of the apparatuses.

Furthermore, according to the present invention, difference of the developer container and the toner container is detected and if the starter container has been mounted to the supply means when supply of toner is required, the developer supply operation is inhibited. Therefore, even if a user has mounted an erroneous container, starter cannot be supplied, obviating any trouble which might be caused by the erroneous container in the apparatus.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus provided with a developing unit for making a visible image out of an electrostatic latent image with use of developer, comprising:

determination means for determining whether or not said developing unit has ever been used;

supply means for supplying the developer from a bottle detachably provided on a body of the apparatus to said developing unit; and control means for actuating said supply means to perform supply operation in response to a determination output from said determination means indicating that said developing unit has never been used.

2. The image forming apparatus according to claim 1, wherein said supply means can perform supply operation in a first mode where said supply means supplies a certain amount and in a second mode where said supply means supplies a certain amount larger than that in said first mode, and said control means allows operation in said second mode.

3. The image forming apparatus according to claim 1, further comprising:

detection means for detecting whether said supply means has performed supply operation or not; and inhibiting means for inhibiting copying operation until a detection output is obtained from aid detection means indicating that said supply means has performed supply operation.

4. An image forming apparatus provided with a developing unit for making a toner image out of an electrostatic latent image with the use of developer composed of toner and carrier, comprising:

supply means for supplying at least either of toner and carrier from a bottle detachably provided on a body of the apparatus to said developing unit;

detection means for detecting that the toner concentration in said developing unit is below a predetermined value;

first control means for actuating said supply means for supplying toner in response to a detection output from said detection means;

determination means for determining whether or not said developing unit has ever been used; and second control means for actuating said supply means for supplying at least carrier in response to a determination output of said determination means indicating that said developing unit has never been used.

5. The image forming apparatus according to claim 4, wherein said determination means is provided on said developing unit and includes storage means for storing data indicating that said developing unit has not been used yet.

6. The image forming apparatus according to claim 4, wherein said developing unit can be attached to and detached from said image forming apparatus.

7. The image forming apparatus according to claim 4, wherein said detection means includes a magnetic sensor, and said determination means makes a determination that said developing unit has not been used yet when it is determined based on an output from said magnetic sensor that no carrier is stored in said developing unit.

8. An image forming apparatus provided with a developing unit for making a toner image out of an electrostatic latent image with the use of developer composed of toner and carrier, comprising:

supply means for supplying at least either of toner and carrier from a bottle detachably provided on a body of the apparatus to said developing unit;

detection means for detecting that a toner bottle containing toner is mounted to said supply means;

determination means for determining that said developing unit has not been used yet; and inhibiting means for inhibiting operation of said supply means in response to a detection output of said detection means and a determination output of said determination means.

9. The image forming apparatus according to claim 8, wherein said determination means is provided on said developing unit and includes storage means for storing data indicating that said developing unit has not been used yet.

10. The image forming apparatus according to claim 8, wherein said determination means makes a determination by detecting whether developer is stored or not in a developer containing portion of said developing unit.

11. An image forming apparatus provided with a developing unit for making a toner image out of an electrostatic latent image with the use of developer composed of toner and carrier, comprising:

supply means for supplying at least either of toner and carrier from a bottle detachably provided on a body of the apparatus to said developing unit;

detection means for detecting that a starter bottle containing at least carrier is mounted to said supply means;

determination means for determining that said developing unit has not been used yet; and inhibiting means for inhibiting operation of said supply means in response to a detection output of said detection means and a determination output of said determination means.

12. The image forming apparatus according to claim 11, further comprising:

canceling means for canceling the inhibition by said inhibiting means on operation of said supply means.

13. The image forming apparatus according to claim 12, wherein said canceling means cancels said inhibition in response to said determination output of said determination means.

14. An image forming apparatus provided with a developing unit for making a visible image out of an electrostatic latent image with use of developer, comprising:

determination means for determining whether the developer is stored or not in said developing unit;

supply means for supplying the developer from a bottle detachably provided on a body of the apparatus to said developing unit;

control means for actuating said supply means to perform supply operation in response to a determination output from said determination means indicating that no developer is stored in said developing unit; and means for supplying a current to the image forming apparatus, supply operation being immediately executed in response to power supply from said current supply means.

* * * * *